US009039163B2

(12) United States Patent
Yoneyama et al.

(10) Patent No.: US 9,039,163 B2
(45) Date of Patent: May 26, 2015

(54) MEDIUM CONVEYANCE APPARATUS AND IMAGE FORMING APPARATUS

(75) Inventors: Nobuaki Yoneyama, Kanagawa (JP); Hiroshi Uemura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 54 days.

(21) Appl. No.: 13/558,386

(22) Filed: Jul. 26, 2012

(65) Prior Publication Data

US 2013/0027492 A1 Jan. 31, 2013

(30) Foreign Application Priority Data

Jul. 27, 2011 (JP) ..... 2011-164513

(51) Int. Cl.

| | |
|---|---|
| ***B41J 2/01*** | (2006.01) |
| ***B41J 13/076*** | (2006.01) |
| ***B41J 13/22*** | (2006.01) |
| ***B41J 2/155*** | (2006.01) |

(52) U.S. Cl.

CPC ..... *B41J 13/076* (2013.01); *B41J 13/226* (2013.01); *B41J 13/223* (2013.01); *B41J 2/155* (2013.01)

(58) Field of Classification Search

CPC ..... B41J 11/007; B41J 11/06; B41J 2/2114; B41J 11/0015; B41J 11/002; B41J 11/42; B41J 29/393; B41J 13/08; B41J 11/0085; B41J 13/226; B41J 13/22; B41J 13/223

USPC ..... 347/102, 101, 104, 16; 101/488; 219/216; 346/25

See application file for complete search history.

(56) References Cited

U.S. PATENT DOCUMENTS

| | | | | |
|---|---|---|---|---|
| 3,025,052 | A * | 3/1962 | Gutteling | 271/94 |
| 3,942,788 | A * | 3/1976 | Boyle | 271/250 |
| 4,858,422 | A * | 8/1989 | Stahlecker | 57/401 |
| 5,213,320 | A * | 5/1993 | Hirota et al. | 271/11 |
| 5,787,809 | A * | 8/1998 | Bosse | 101/226 |
| 6,050,469 | A * | 4/2000 | Brabant et al. | 226/183 |
| 6,074,056 | A * | 6/2000 | Kubo et al. | 347/104 |
| 6,092,894 | A * | 7/2000 | Nuita et al. | 347/104 |
| 6,250,581 | B1 * | 6/2001 | Cramer | 242/541.7 |
| 6,438,352 | B1 * | 8/2002 | Landa et al. | 399/401 |
| 6,746,010 | B2 * | 6/2004 | Ozaki | 271/3.21 |
| 7,997,198 | B2 * | 8/2011 | Koberg et al. | 101/401.1 |
| 8,033,640 | B2 * | 10/2011 | Koike et al. | 347/36 |

(Continued)

FOREIGN PATENT DOCUMENTS

| | | | |
|---|---|---|---|
| JP | 11-092008 | A | 4/1999 |
| JP | 2008-230819 | A | 10/2008 |
| JP | 2009-220954 | A | 10/2009 |
| JP | 2009-234781 | A | 10/2009 |
| JP | 2011-051735 | A | 3/2011 |

*Primary Examiner* — Julian Huffman
*Assistant Examiner* — Leonard S Liang
(74) *Attorney, Agent, or Firm* — Birch, Stewart, Kolasch & Birch, LLP

(57) ABSTRACT

According to an aspect of the present invention, in a medium conveyance apparatus which securely supports and conveys a medium, by providing a function for applying a back tension to the medium, in a guide section which forms a guide for supporting the medium in a medium conveyance unit, it is possible to apply a back tension to the medium of which at least a portion is securely supported by the medium conveyance unit, thereby restricting the occurrence of creasing and floating when the medium is securely supported by the medium conveyance unit and maintaining the flatness of the medium which is securely supported by the medium conveyance unit.

6 Claims, 20 Drawing Sheets

(56) References Cited

U.S. PATENT DOCUMENTS

2009/0231377 A1 9/2009 Kachi
2009/0231407 A1* 9/2009 Kachi ..... 347/104
2009/0295894 A1* 12/2009 Hori ..... 347/102
2009/0322824 A1* 12/2009 Hori ..... 347/30
2010/0165033 A1* 7/2010 Fukui ..... 347/16
2011/0025807 A1* 2/2011 Fukui ..... 347/104
2013/0168918 A1* 7/2013 Yap et al. ..... 271/94

* cited by examiner

FIG.9

| WIDTH H (mm) | LENGTH L (mm) | THICKNESS T (mm) | BLOWING PRESSURE E (kPa) | SUCTION PRESSURE IN GUIDE ROLLER Q (kPa) | SUCTION PRESSURE IN PRESSURE DRUM W (kPa) | (E+Q)/W |
|---|---|---|---|---|---|---|
| $H_1$ | $L_1$ | $T_1 \geqq T$ | 0.5 | 9 | 2.7(20) | 3.6 |
| | | $T_1 < T < T_2$ | 0.7 | 11 | 3.6(40) | 3.3 |
| | | $T_2 \leqq T$ | 1.0 | 13 | 4.4(50) | 3.2 |
| $H_2$ | $L_2$ | $T_1 \geqq T$ | 0.5 | 9 | 2.0(20) | 4.7 |
| | | $T_1 < T < T_2$ | 0.7 | 11 | 3.3(30) | 3.9 |
| | | $T_2 \leqq T$ | 1.0 | 13 | 4.0(40) | 3.5 |
| $H_3$ | $L_3$ | $T_1 \geqq T$ | 0.5 | 9 | 2.1(20) | 4.4 |
| | | $T_1 < T < T_2$ | 0.7 | 11 | 3.2(30) | 3.7 |
| | | $T_2 \leqq T$ | 1.0 | 13 | 4.3(40) | 3.3 |
| $H_4$ | $L_4$ | $T_1 \geqq T$ | 0.5 | 9 | 1.2(10) | 8.0 |
| | | $T_1 < T < T_2$ | 0.7 | 11 | 2.4(20) | 4.9 |
| | | $T_2 \leqq T$ | 1.0 | 13 | 3.6(30) | 3.9 |

MEDIUM CONVEYANCE APPARATUS AND IMAGE FORMING APPARATUS

BACKGROUND OF THE INVENTION

1. Field of the Invention

The present invention relates to a medium conveyance apparatus and an image forming apparatus, and more particularly to medium secure supporting technology and medium conveyance technology for suppressing floating of a medium.

2. Description of the Related Art

In an inkjet recording apparatus, guaranteeing the planarity (flatness) of the printing surface (image forming surface) of the recording medium directly below the inkjet head is directly linked to image quality. For instance, if creasing or floating of the recording medium occurs and a prescribed planarity is not guaranteed, then this leads to decline in the image quality, and therefore in an inkjet recording apparatus, various modifications are made in order to guarantee the planarity of the printing surface of the recording medium.

Japanese Patent Application Publication No. 2001-51735 discloses a composition in which a recording medium is vacuum suctioned from the rear side of a printing surface while the recording medium is pressed against a medium holding surface from a printing surface side, by using a roller-shaped pressing member, so as to make tight contact with the medium holding surface, in such a manner that the recording medium is held reliably without floating up from the medium holding surface.

Japanese Patent Application Publication No. 2009-220954 discloses a composition for suppressing floating and creasing of a recording medium by causing a back tension to act on a trailing end of the recording medium. Furthermore, Japanese Patent Application Publication No. 2009-234781 discloses a composition in which a tension is caused to act on the recording medium outwards in a width direction which is perpendicular to the conveyance direction of the recording medium.

Japanese Patent Application Publication No. 11-92008 discloses a composition which holds and conveys a leading end of a sheet by chain grippers provided on an endless chain, in which a roller-shaped vacuum suction wheel is provided on a conveyance path of the sheet, a negative pressure is generated on an outer circumferential surface of the vacuum suction wheel, and a back tension is applied to the sheet by contact (slipping) between the outer circumferential surface of the vacuum suction wheel and the sheet.

Japanese Patent Application Publication No. 2008-280819 discloses a paper conveyance mechanism which conveys paper on a belt, in which a voltage is applied between a paper pressing roller and a supporting roller so as to electrostatically suction and hold the paper until the paper reaches a suctioning device.

However, in the compositions described in Japanese Patent Application Publication No. 2011-51735, Japanese Patent Application Publication No. 2009-220954, Japanese Patent Application Publication No. 2009-234781, Japanese Patent Application Publication No. 11-92008 and Japanese Patent Application Publication No. 2008-230819, it is difficult to guarantee the flatness of the printing surface if the paper is affected by deformation, such as curl. For example, if flapping of the trailing end of the recording medium occurs, or the recording medium has strong curl, then in a composition which presses the recording medium with a roller, as disclosed in Japanese Patent Application Publication No. 2011-51735, Japanese Patent Application Publication No. 2009-220954, Japanese Patent Application Publication No. 2009-234781 and Japanese Patent Application Publication No. 2008-230819, creasing occurs when the recording medium is pressed with the roller.

Furthermore, in the composition disclosed in Japanese Patent Application Publication No. 11-92008, when curl occurs in the sheet, the contact surface area between the sheet and the vacuum suction wheel becomes small, and it is difficult to make a sufficiently large back tension act on the sheet.

SUMMARY OF THE INVENTION

The present invention was devised in view of these circumstances, an object thereof being to provide a medium conveyance apparatus and an image forming apparatus whereby floating up and flapping of the trailing end of a recording medium is suppressed and the occurrence of creases in the recording medium can be prevented.

In order to achieve the aforementioned object, the medium conveyance apparatus relating to the present invention comprises: a medium conveyance unit which has a medium supporting region that supports a rear surface of a medium and which conveys the medium in a prescribed conveyance direction while supporting the medium; and a guide section which is disposed adjacently on an upstream side, in terms of the medium conveyance direction, to a support start position where secure supporting of the medium by the medium conveyance unit is started in a conveyance path of the medium, and which contacts a surface of the medium and causes the medium to make tight contact with the medium conveyance unit, wherein the guide section has a suction port provided in a position opposing the medium and applies a back tension to the medium, at least a portion of which is securely supported by the medium supporting region, by applying suction pressure from the suction port to a portion of the medium that is not securely supported by the medium supporting region.

According to the present invention, in a medium conveyance apparatus which securely supports and conveys a medium, by providing a function for applying a back tension to the medium, in a guide section which forms a guide for supporting the medium in a medium conveyance unit, it is possible to apply a back tension to the medium of which at least a portion is securely supported by the medium conveyance unit, thereby restricting the occurrence of creasing and floating when the medium is securely supported by the medium conveyance unit and maintaining the flatness of the medium which is securely supported by the medium conveyance unit.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 9 is an illustrative diagram showing examples of settings for the magnitude of the blowing pressing, the magnitude of the suction pressure in the guide roller, and the magnitude of the suction pressure in the pressure drum;

DESCRIPTION OF THE PREFERRED EMBODIMENTS

Below, a desirable embodiment of the present invention is described in detail with reference to the accompanying drawings.

First Embodiment

General Composition

Figure 1:
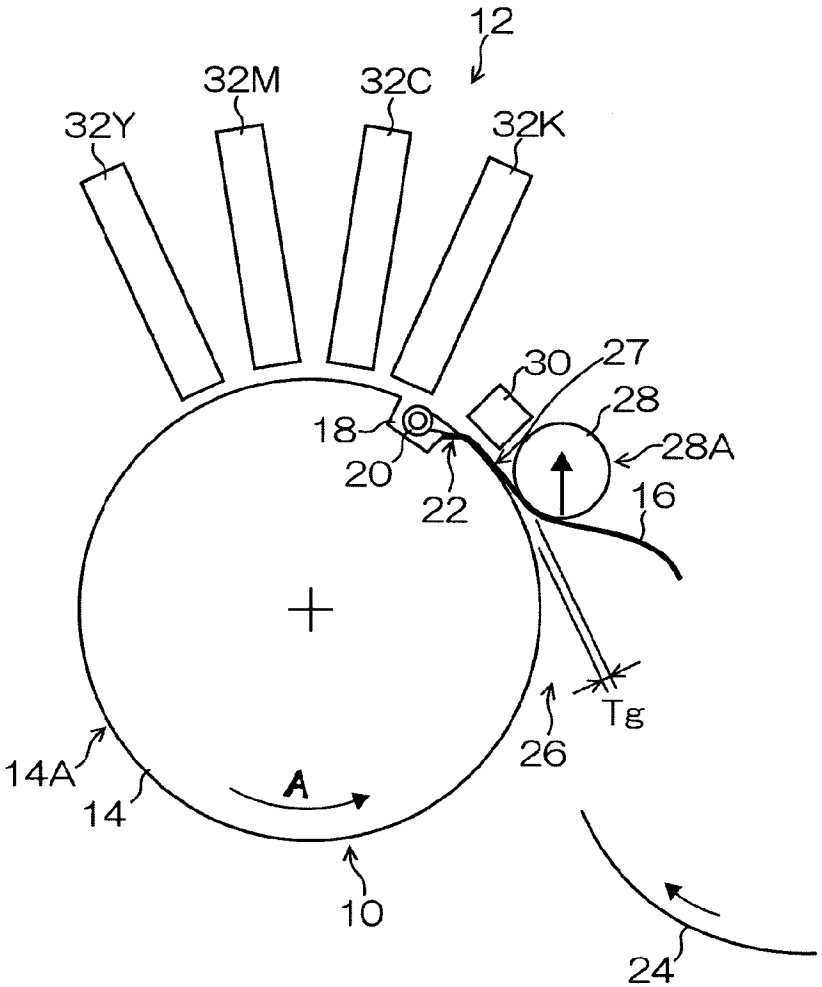
FIG. 1 is a schematic drawing of an inkjet recording apparatus comprising a paper conveyance apparatus relating to a first embodiment of the present invention.

FIG. 1 is a general schematic drawing showing an approximate composition of an inkjet recording apparatus 12 which comprises a paper conveyance apparatus 10 relating to the first embodiment of the present invention.

The paper conveyance apparatus 10 comprises a pressure drum (image formation drum) 14 and is configured so as to rotate paper (a medium) 16 in a counter-clockwise direction as indicated by the arrow A, while holding the paper 16 on the outer circumferential surface 14A of the pressure drum 14 by generating a negative pressure at suction holes (not illustrated) provided on an outer circumferential surface (paper holding surface) 14A of the pressure drum 14, in such a manner that the paper 16 is conveyed in a circumferential direction.

The pressure drum 14 comprises a gripper 20 for gripping the leading end portion of the paper 16, inside a recess section 18 provided in the outer circumferential surface 14A. The gripper 20 is configured so as to grip the leading end portion of the paper 16 against a hook base 22 provided inside the recess section 18.

In the paper conveyance apparatus 10 shown in FIG. 1, a guide roller 28 is disposed immediately after (adjacently to the downstream side of) a transfer section 26 where paper 16 conveyed along a conveyance guide 24 is transferred to a pressure drum 14 by a transfer drum (not illustrated). The guide roller 28 functions as a guide member which causes paper 16 of which the leading end portion is being gripped by the gripper 20 to make tight contact with the outer circumferential surface 14A of the pressure drum 14.

The "transfer section 26" referred to here is a position where the gripper 20 which rotates together with the pressure drum 14 grips the leading end portion of the paper 16, in the conveyance path of the paper 16. Furthermore, "immediately after the transfer section 26" means a region on the downstream side of the transfer section 26 in the paper conveyance direction, between the transfer section 26 and a paper floating detection sensor 30, which is described below.

Furthermore, a position (supporting start position) 27 at which the paper 16 starts to be supported on the outer circumferential surface 14A of the pressure drum 14 in the conveyance path of the paper 16 is between the guide roller 28 and the paper floating detection sensor 30 (downstream side of the guide roller 28 in the paper conveyance direction).

When the gripper 20 which has moved due to rotation from the transfer section 26 to the pressure drum 14 passes the guide roller 28, and further passes the supporting start position 27, then the portion of the paper 16 which has reached the supporting start position 27 starts to be supported on the outer circumferential surface 14A of the pressure drum 14.

On the other hand, the portion of the paper 16 which is not supported on the outer circumferential surface 14A of the pressure drum 14 receives a back tension from the guide roller 28.

The guide roller 28 is arranged in such a manner that a prescribed clearance $T_g$ is provided between the outer circumferential surface 14A of the pressure drum 14 and the guide roller 28. The clearance $T_g$ between the outer circumferential surface 14A of the pressure drum 14 and the guide roller 28 is a value which exceeds 1.5 times the largest value of the paper thickness and is no more than 2 times the largest value of the paper thickness.

Thick paper is more rigid that thin paper and less liable to follow the shape of the guide roller 28 and therefore more liable to produce floating or creasing. On the other hand, thin paper is less rigid that thick paper and more liable to follow the shape of the guide roller 28 and therefore less liable to produce floating or creasing.

Therefore, if the clearance between the outer circumferential surface 14A of the pressure drum 14 and the guide roller 28 is determined in accordance with the thickness of thick paper which is less liable to follow the shape of the guide roller 28, then compatibility is also achieved with cases where papers of various thicknesses are used.

Of course, it is also possible to adopt a mode which comprises a device for adjusting the clearance between the outer circumferential surface 14A of the pressure drum 14 and the guide roller 28, and the clearance between the outer circumferential surface 14A of the pressure drum 14 and the guide roller 28 is adjusted in accordance with the paper thickness.

In the paper conveyance apparatus 10 described in the present embodiment, a function of applying a back tension to the paper 16 is added to the guide roller 28. By applying a back tension to the paper 16 which is conveyed by gripping the front end portion thereof, to the portion of the paper 16 which is not supported on the outer circumferential surface 14A of the pressure drum 14, the occurrence of floating and creasing when the paper 16 is suctioned onto the outer circumferential surface 14A of the pressure drum 14 is suppressed, and the flatness of the paper 16 during conveyance is guaranteed.

A paper floating detection sensor 30 which detects floating of the paper 16 is disposed on the downstream side of the guide roller 28 in the paper conveyance direction. The paper floating detection sensor 30 detects the amount of floating (the height from the outer circumferential surface 14A of the pressure drum 14) of the portion of the paper 16 which has passed by the guide roller 28 and is supported on the outer circumferential surface 14A of the pressure drum 14. If the amount of floating or the height of creases thus detected in the paper 16 exceeds a prescribed threshold value, then the conveyance of the paper 16 is halted and this fact is reported.

Droplets of color inks are ejected by the inkjet heads 32 (32K, 32C, 32M, 32Y) onto the paper 16 having guaranteed flatness in this way, thereby forming a prescribed color image.

In the inkjet recording apparatus 12 shown in the present example, in order to guarantee image quality, the clearance between the inkjet head 32 and the paper 16 held on the outer circumferential surface 14A of the pressure drum 14 is set to no more than 1 millimeter.

If floating or creasing exceeding this clearance occurs in the paper 16, then the paper 16 makes contact with the inkjet head 32, and the nozzle surface of the inkjet head 32 may be damaged.

In the paper conveyance apparatus 10 shown in the present embodiment (inkjet recording apparatus 12), since the occurrence of floating or creasing of the paper 16 when passing directly below the inkjet head 32 is prevented, and a prescribed flatness is guaranteed, then it is possible to avoid damage to the nozzle surface as a result of contact between the nozzle surface of the inkjet head 32 and the paper 16.

(Description of Guide Roller)

Figure 2:
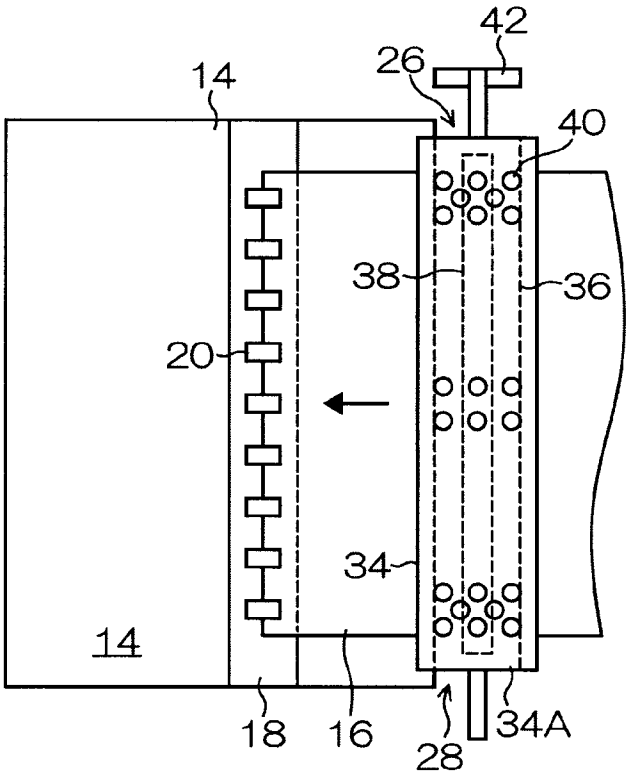
FIG. 2 is an illustrative diagram describing an arrangement of a guide roller in the paper conveyance apparatus shown in FIG. 1.

FIG. 2 is an illustrative diagram showing the arrangement of the guide roller 28 in the paper conveyance apparatus 10 shown in FIG. 1, and depicts a plan diagram of the outer circumferential surface 14A of the pressure drum 14 viewed from the upper side (the side where the inkjet head 32 in FIG. 1 is arranged).

As shown in FIG. 2, the guide roller 28 is arranged on the upper side of the pressure drum 14 in terms of the paper conveyance direction (indicated by the arrow in the drawing). When the gripper 20 has passed directly below the guide roller 28, a back tension is applied to the paper 16 from the guide roller 28.

The guide roller 28 has a structure in which an inner roller 36 (indicated by the dotted lines) is inserted into a hollow outer roller 34, and the outer roller 34 is supported rotatably about a central axle of the guide roller 28.

On the other hand, the inner roller 36 which is inserted into the outer roller 34 is supported securely on the central axle of the guide roller 28, and a prescribed clearance is provided between the inner roller 36 and the outer roller 34 in such a manner that the outer roller 34 does not contact the inner roller 36 when it rotates.

A suction port 38 (indicated by the dotted lines) is provided at a position on the inner roller 36 which opposes the paper 16, and the suction port 38 has a length corresponding to the maximum width of the paper 16 in the width direction which is perpendicular to the conveyance direction of the paper 16.

A plurality of suction holes (through holes) 40 are provided in the outer circumferential surface 34A of the outer roller 34, and when the outer roller 34 rotates, a suction pressure is applied to the paper 16 from the suction holes 40 which have reached the position of the suction port 38.

The suction port 38 is connected to a suction pump (not shown in FIG. 2, indicated by reference numeral 68 in FIG. 6) via an air flow channel (not illustrated) which is provided in the inner roller 36, and when a negative pressure (suction pressure) is generated at the suction port 38 by operating the suction pump, the paper 16 can be suctioned onto the outer circumferential surface 34A of the outer roller 34 (the outer circumferential surface 28A of the guide roller 28) via the suction holes 40.

As shown in FIG. 2, a torque limiter 42 is attached to the guide roller 28 and by causing the torque limiter 42 to act on the rotation of the guide roller 28 in a state where the paper 16 has been suctioned onto the outer circumferential surface 28A of the guide roller 28, it is possible to apply a uniform load to the paper 16 and tension the paper 16 in the paper conveyance direction.

As a further mode of applying back tension to the paper 16 by the guide roller 28, there is a mode in which the paper 16 and the outer circumferential surface 28A of the guide roller 28 are caused to rub against each other (to apply a frictional load). A concrete example of such a mode is one where a material having high surface roughness is wrapped about the outer circumferential surface 28A of the guide roller 28.

On the other hand, a magnitude |Q| of the suction pressure Q of the guide roller 28 is determined in such a manner that the relationship between the magnitude (absolute value) |W| of the suction pressure W of the pressure drum 14 and the magnitude |Q| of the suction pressure Q of the guide roller 28 satisfies the following equation:

$$|W|\times 2<|Q|.$$

In other words, by determining the magnitude |Q| of the suction pressure Q of the guide roller 28 so as to have a value exceeding two times the magnitude |W| of the suction pressure W of the pressure drum 14, the trailing end portion of the paper 16 is prevented from adhering to the outer circumferential surface of the pressure drum 14 before the trailing end portion of the paper 16 passes the guide roller 28.

The magnitude |W| of the suction pressure W of the pressure drum 14 is adjusted suitably in accordance with the size and thickness of the paper 16 (see FIG. 9), and the magnitude |Q| of the suction pressure Q of the guide roller 28 is adjusted suitably on the basis of the magnitude |w| of the suction pressure W of the pressure drum 14 which is adjusted in accordance with the size and thickness of the paper 16.

Figure 3:
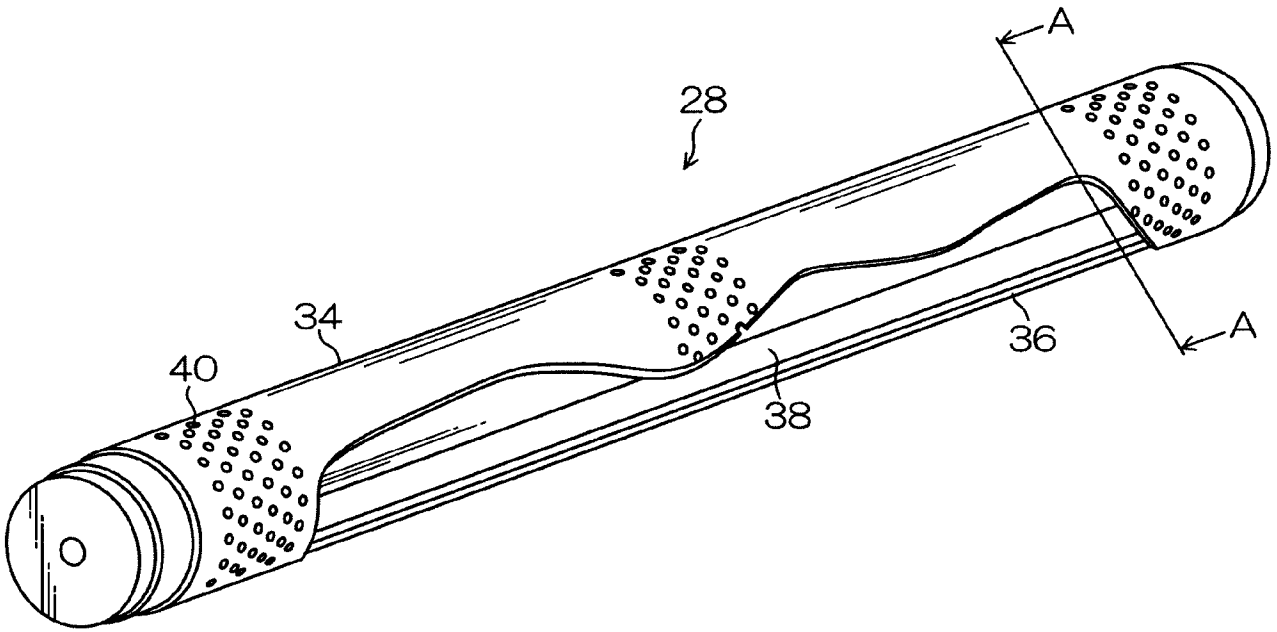
FIG. 3 is a perspective diagram showing the structure of the guide roller shown in FIG. 1.
Figure 4:
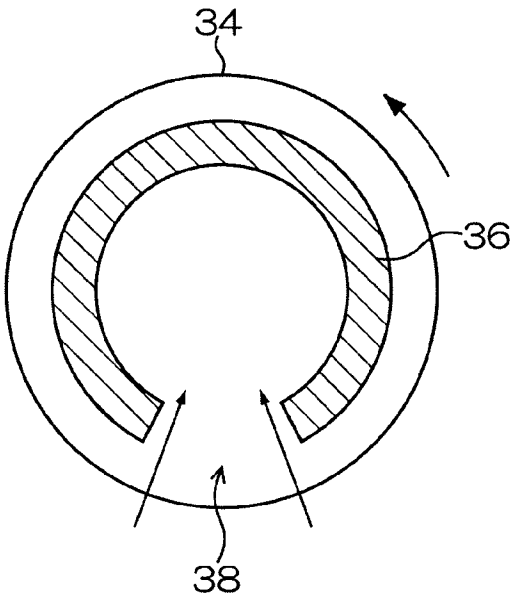
FIG. 4 is a cross-sectional diagram showing an internal structure of the guide roller shown in FIG. 1.

FIG. 3 is a perspective diagram showing the general structure of the guide roller 28, and depicts a view in which a portion of the outer roller 34 is cut away to expose the inner roller 36. FIG. 4 is a cross-sectional diagram of the guide roller 28 (a cross-sectional view along line A-A in FIG. 3). FIG. 4 does not depict the thickness of the outer roller 34, the suction holes 40, or the detailed internal structure of the inner roller 36.

Suction holes 40 are provided in the outer roller 34 shown in FIG. 3, in the both end portions and the central portion thereof in the axial direction. If the paper 16 is curled, then the curled paper 16 can readily be made to follow the shape of the outer circumferential surface 28A of the guide roller 28, by concentrating the suction pressure in the both end portions and the central portion of the paper 16 in the width direction thereof, and hence paper curl can be suppressed efficiently.

As shown in FIG. 3 and FIG. 4, the suction port 38 which is provided in the inner roller 36 is arranged in a lowermost portion of the inner roller 36 (a position opposing the paper 16) and is directed vertically downwards. A desirable mode is one in which the suction port 38 is arranged at a position where a vertical line traced downwards from the suction port 38 does not contact the outer circumferential surface 14A of the pressure drum 14.

More specifically, the suction port 38 may be arranged to the upper side of the lowermost portion of the inner roller 36, but if so arranged, then desirably the suction port 38 is arranged distantly from the pressure drum 14. For example, in the composition shown in FIG. 1, a suction port 38 may be arranged on the opposite side to the pressure drum 14 (in FIG. 1, the right-hand side of the guide roller 28).

The width of the suction port 38 in the circumferential direction is determined suitably from the viewpoint of guaranteeing the suction flow rate and maintaining the suction pressure. In the present embodiment, the width of the suction port 38 is taken to be about 1/16th of the length of the whole circumference of the outer roller 34. The arrow shown in FIG. 4 represents the suction direction of the inner roller 36.

Figure 5:
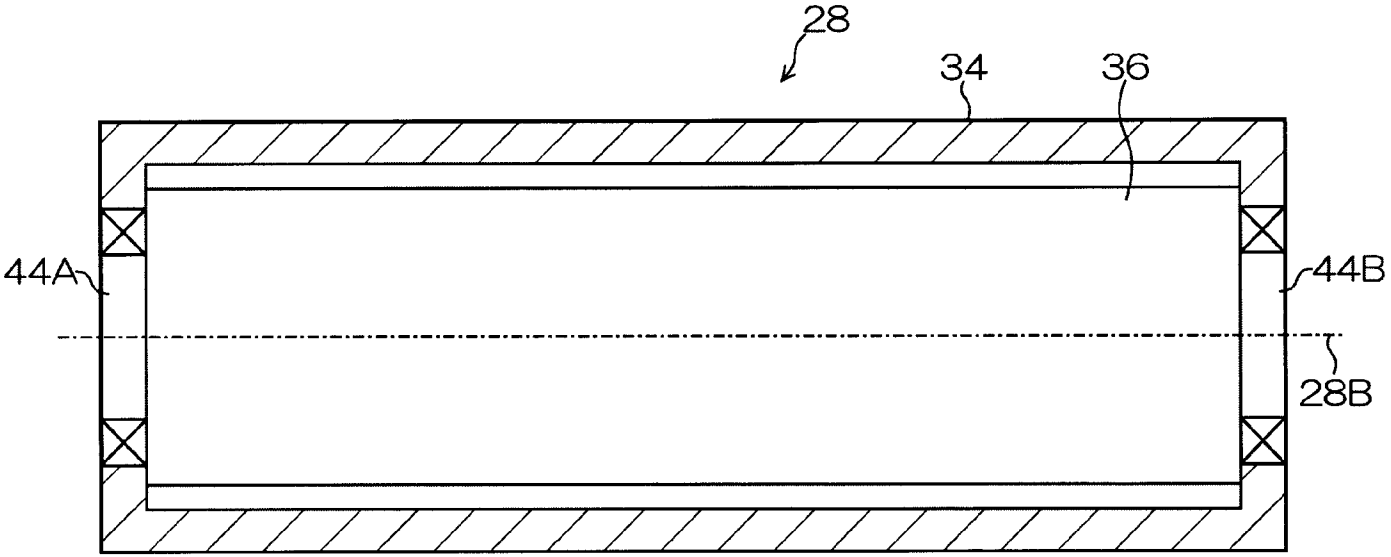
FIG. 5 is a cross-sectional diagram showing a supporting structure of an outer roller in the guide roller shown in FIG. 1.

FIG. 5 is a cross-sectional diagram showing one example of a supporting structure of the outer roller 34. As shown in FIG. 5, the inner roller 36 is supported securely on the central axle 28B of the guide roller 28, and the outer roller 34 is supported by bearings 44A, 44B which are installed on either end portion of the inner roller 36 in the axial direction thereof.

By adopting a structure of this kind, the outer roller 34 is able to rotate about the inner roller 36 which is secured in position.

Figure 6:
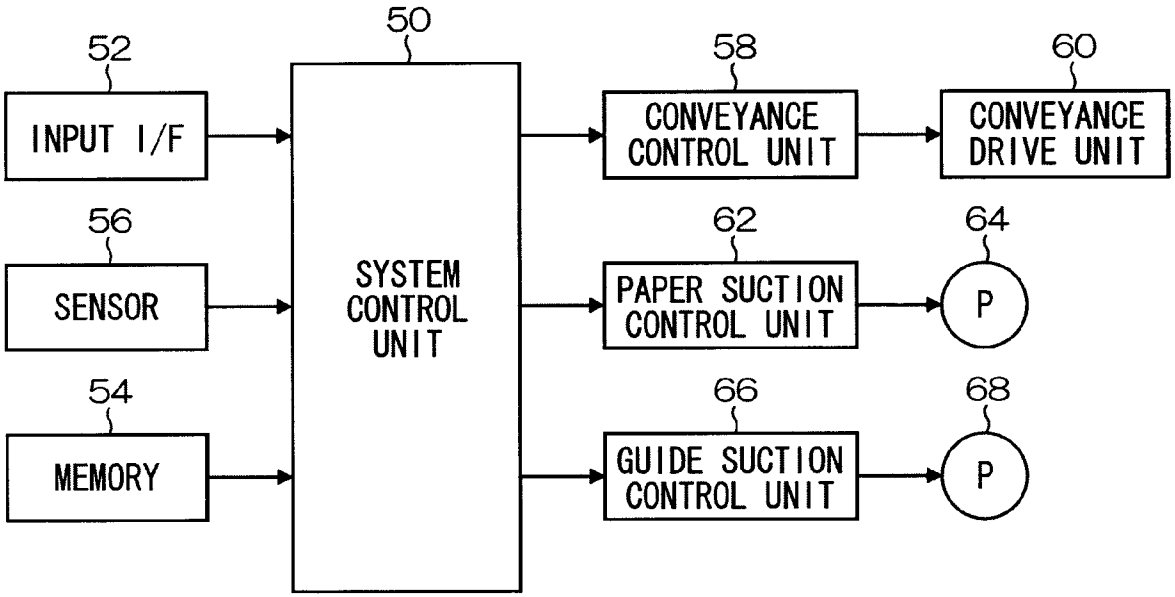
FIG. 6 is a block diagram showing a configuration of a control system of the paper conveyance apparatus shown in FIG. 1.

FIG. 6 is a block diagram showing a composition of a control system of the paper conveyance apparatus 10 shown in the present embodiment. The system control unit 50 is a block which performs integrated control of each part of the paper conveyance apparatus 10, and is constituted by one or a plurality of processors.

An input interface (input I/F) 52 is a block by which information (data) from an external source is incorporated into the paper conveyance apparatus 10. A user interface, such as a keyboard, mouse or touch panel type display, and a data input terminal, such as a LAN port, are included in the input interface 52.

The information input via the input interface 52 is sent to the system control unit 50. The system control unit 50 stores required information, of the input information, in a memory 54, and also generates instruction signals to be sent to each part of the apparatus on the basis of this information, and sends these signals to the respective parts of the apparatus.

The sensor 56 includes sensors of various types, such as a paper floating detection sensor 30 as shown in FIG. 1, a temperature sensor, and a sensor which determines a position of the paper, and the like. The detection signal acquired by the sensor 56 is sent to the system control unit 50.

The system control unit 50 stores required information (data) from the detection signal sent from the sensor 56, in the memory 54, as appropriate, and also generates an instruction for each part of the apparatus, and sends the generated instruction signal to the respective parts of the apparatus.

The conveyance control unit 58 controls the conveyance drive unit 60 which operates the pressure drum 14 (see FIG. 1) on the basis of the instruction signal which is sent from the system control unit 50. The conveyance drive unit 60 includes a motor and a drive mechanism.

A paper suction control unit 62 controls the on/off switching and the speed (flow rate) of the paper suction pump 64 which generates suction pressure on the paper 16 at the pressure drum 14 (see FIG. 1), on the basis of the instruction signal sent from the system control unit 50.

When size and thickness information about the paper 16 (paper information) is acquired, the speed of the paper suction pump 64 is set by referring to a table which stores values of the speed (flow rate) of the paper suction pump 64 in relation to the paper information.

The guide roller suction control unit 66 controls the operation of the suction pump 68 which generates a suction pressure in the guide roller 28 (see FIG. 1), on the basis of the instruction signal sent from the system control unit 50. The speed of the suction pump 68 is set by referring to a table which stores the relationship between the paper information (or information about the speed of the paper suction pump 64) and the speed (flow rate) of the suction pump 68.

The memory 54 may include a main storage apparatus (semiconductor storage element) or an auxiliary storage apparatus (magnetic storage element), and may be constituted by a plurality of storage elements. For example, the concept of the memory 54 includes a memory which is used as a one-dimensional storage region or a calculating region for data, or a memory which stores operational parameters (tables), various settings, processing programs, and the like.

The composition of the control system of the inkjet recording apparatus 12 is omitted, but the control system of the paper conveyance apparatus 10 shown in FIG. 6 is constituted by a data input unit by which image data is input (the image data being digital data in a serial format having a data value from 0 to 255), an image processing unit which generates printing data (dot data) by applying prescribed image processing to the image data, and a head drive unit which generates a drive voltage of the inkjet head on the basis of the dot data.

According to the paper conveyance apparatus 10 which is configured as described above, a function for applying back tension to the paper 16 of which the leading end portion is secured by the gripper 20, is added to the guide roller 28 which is a guide for causing the paper 16 to make tight contact with the outer circumferential surface 14A of the pressure drum 14, and therefore it is possible to apply back tension in the guide region of the guide roller 28 immediately after the transfer section 26 where the paper 16 is transferred to the pressure drum 14, and the occurrence of floating or creasing of the paper 16 can be suppressed effectively.

Furthermore, it is also possible to reduce the space occupied by the apparatus, in comparison with a mode which comprises a device that applies back tension, separately from the guide roller 28.

By making the relationship between the magnitude $|W|$ of the suction pressure W of the pressure drum 14 and the magnitude $|Q|$ of the suction pressure Q of the guide roller 28 satisfy the relationship $|W|\times 2<|Q|$, the trailing end portion, and the like, of the paper 16 is prevented from being suctioned onto the outer circumferential surface 14A of the pressure drum 14 before the trailing end portion of the paper 16 passes directly below the guide roller 28.

Second Embodiment

Figure 7:
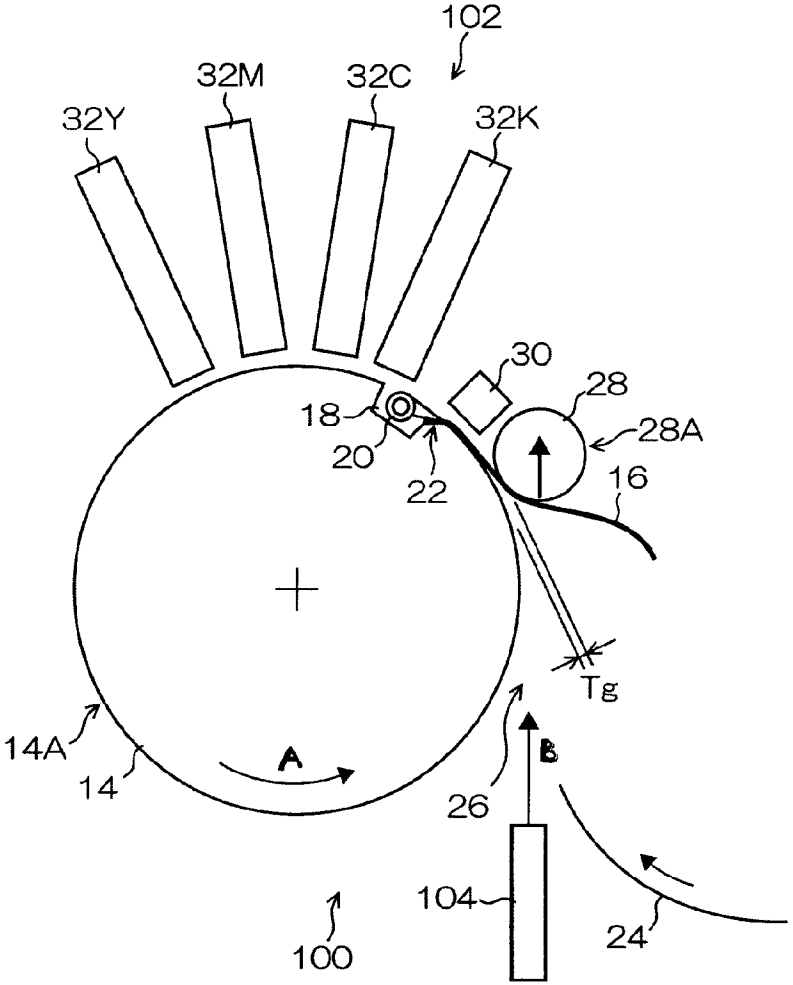
FIG. 7 is a schematic drawing of an inkjet recording apparatus comprising a paper conveyance apparatus relating to a second embodiment of the present invention.

FIG. 7 is a general schematic drawing showing an approximate composition of a paper conveyance apparatus 100 (inkjet recording apparatus 102) relating to the second embodiment of the present invention. In FIG. 7, parts which are the same as or similar to FIG. 1 are labeled with the same reference numerals and further explanation thereof is omitted here.

The paper conveyance apparatus 100 shown in FIG. 7 is the paper conveyance apparatus 10 shown in FIG. 1 with an added air blowing unit 104. The air blowing unit 104 is arranged at a position directly below the guide roller 28 and functions as an assisting device which sprays air towards the rear surface of the paper 16 passing directly thereabove (the air blowing direction is indicated by an arrow B in FIG. 7) and thereby suctions the paper 16 onto the outer circumferential surface 28A of the guide roller 28.

Furthermore, air sprayed from the air blowing unit 104 is directed towards the suction port 38 of the guide roller 28 (see FIG. 2) from between the pressure drum 14 and the conveyance guide 24, and when the air strikes the rear side of the paper 16 which has been transferred to the pressure drum 14, the air acts so as to separate the trailing end portion of the paper 16 from the outer circumferential surface 14A of the pressure drum 14 which is on the upstream side of the guide roller 28 in terms of the paper conveyance direction.

Figure 8A:
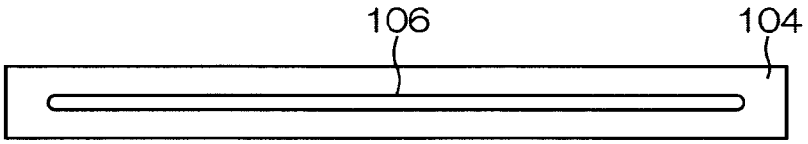
FIGS. 8A to 8C are illustrative diagrams each describing the shape of an air blowing port of the blowing unit shown in FIG. 7.
Figure 8B:
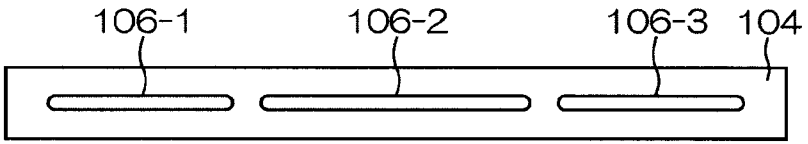
Figure 8C:
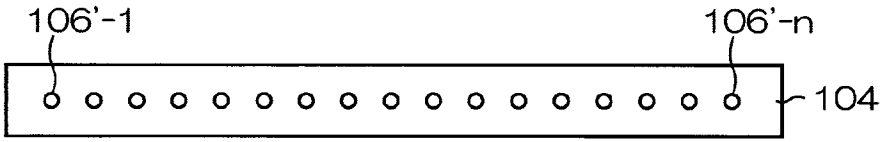

FIGS. 8A to 8C are plan diagrams of the air blowing unit 104 viewed from the side of the guide roller 28.

As FIGS. 8A to 8C show, a spraying port 106 is provided in the air blowing unit 104 through a length corresponding to the entire width of the paper 16.

In the mode shown in FIG. 8A, a spraying port 106 having an oval (elliptical, elongated elliptical) planar shape is provided, the spraying port having a length in the lengthwise direction which corresponds to the entire width of the paper 16. In the mode shown in FIG. 8B, the spraying port 106 which has an oval planar shape is divided into three parts (106-1, 106-2, 106-3).

In the mode shown in FIG. 8C, n spraying ports 106' (106'-1 to 106'-n) which have a circular planar shape are arranged an even spacing through a length corresponding to the entire width of the paper 16.

The magnitude |W| of the suction pressure W of the pressure drum 14 and the magnitude |Q| of the suction pressure Q of the guide roller 28 and the magnitude |E| of the air blowing pressure E of the air blowing unit 104 satisfy the following condition:

$$|W|\times 2<|Q|+|E|.$$

On the other hand, if the sum (|Q|+|E|) of the magnitude |Q| of the suction pressure Q of the guide roller 28 and the magnitude |E| of the air blowing pressure E of the air blowing unit 104 exceeds five times the magnitude |W| of the suction pressure W of the pressure drum 14, then air blowing from the air blowing unit 104 is halted or reduced.

In this way, by adjusting the air blowing by the air blowing unit 104 suitably if the upper limit of the back tension is exceeded, then flapping of the paper 16 due to excessive air blowing and disturbance due to counter-currents inside the apparatus is suppressed.

FIG. 9 is an illustrative diagram showing an example of the settings of the magnitude |E| of the air blowing pressure E of the air blowing unit 104, the magnitude |Q| of the suction pressure Q of the guide roller 28, and the magnitude |W| of the suction pressure W of the pressure drum 14, for each size of paper 16. The numerical values in parentheses for the suction pressure W of the pressure drum 14 are the suction pressure settings (kP) of the pressure drum 14.

In FIG. 9, the width H (expressed in millimeters) of the paper 16 is a length in a direction perpendicular to the paper conveyance direction, and $H_1>H_2>H_3>H_4$. Furthermore, the length L (millimeters) of the paper 16 is the length in the paper conveyance direction, and $L_1>L_2>L_3>L_4$.

The air sprayed from the air blowing unit 104 should strike at least the trailing end portion of the paper 16, and the air blowing unit 104 may be operated intermittently in conjunction with determining the position of the paper 16, in such a manner that the air blowing unit 104 is operated in accordance with the timing at which the trailing end portion of the paper 16 passes over the air blowing region of the air blowing unit 104, and the air blowing unit 104 is halted before and after the trailing end portion of the paper 16 passes over the air spraying region of the air blowing unit 104.

Furthermore, it is also possible to adopt a composition in which air is blown with a strong pressure constantly in the case of thick paper and air is blown only onto the trailing end portion of the paper in the case of thin paper. According to this mode, it is possible to blow air with good efficiency in accordance with the mode of the paper 16.

According to the paper conveyance apparatus 100 relating to the second embodiment described above, by providing an air blowing unit 104 which blows air toward the rear surface of the paper 16, as a device for applying back tension to the paper 16, it is also possible to apply back tension effectively to the paper 16 even in the case of using paper 16 to which it is difficult to apply back tension by the guide roller 28. Therefore the reliability of the back tension is improved.

Furthermore, by adjusting the blowing pressure of the air blowing unit 104 in accordance with the type (thickness) of paper 16, it is possible to achieve compatibility with papers 16 of various types, and air can be blown with good efficiency.

Third Embodiment

Next, a paper conveyance apparatus 120 relating to a third embodiment of the present invention will be described. In the following description, parts which are the same as or similar to the first and second embodiments which were described previously are labeled with the same reference numerals and further explanation thereof is omitted here.

The paper conveyance apparatus 120 shown in the present embodiment is configured in such a manner that the suction flow rate of the guide roller 28 is determined and the method of applying back tension from the guide roller 28 is changed in accordance with the state of curl of the paper 16.

Examples of factors which cause curl in paper 16 are change in the ambient temperature and ambient humidity of the paper 16, single-side printing during the course of a double-side printing operation, and the like.

Figure 10:
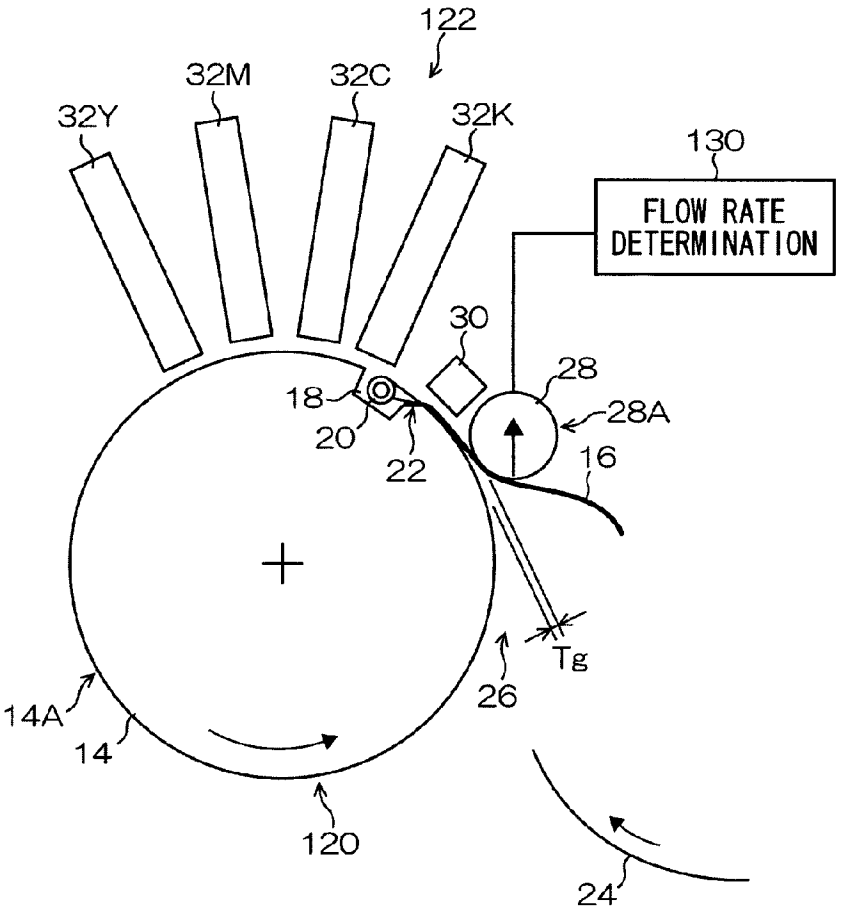
FIG. 10 is a schematic drawing of an inkjet recording apparatus comprising a paper conveyance apparatus relating to a third embodiment of the present invention.

FIG. 10 is a general schematic drawing showing an approximate composition of a paper conveyance apparatus 120 (inkjet recording apparatus 122) relating to a third embodiment of the present invention. The paper conveyance apparatus 120 shown in FIG. 10 comprises a guide roller 128 in which the structure of the guide roller 28 is changed in comparison with the paper conveyance apparatus 10 shown in FIG. 1, as well as comprising a suction flow rate determination unit 130 which determines the suction flow rate of the guide roller 128. As shown in FIG. 7, it is also possible to adopt a mode which combines an air blowing unit 104.

Figure 11:
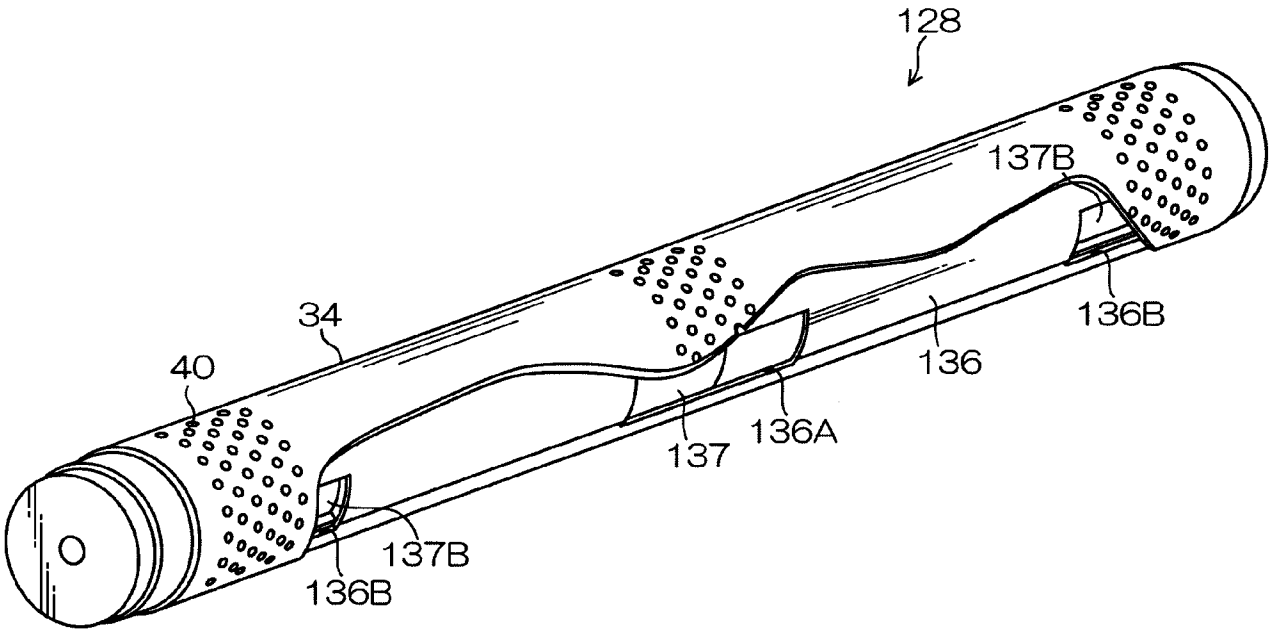
FIG. 11 is a perspective diagram of the guide roller shown in FIG. 10.

FIG. 11 is a perspective diagram showing the structure of the guide roller 128. The guide roller 128 has a triple structure, in which a suction angle cylinder 136 having a hollow structure is inserted inside a hollow outer roller 34, and furthermore, a suction position cylinder 137 is inserted inside the suction angle cylinder 136.

A plurality of suction holes 40 are provided in the outer circumferential surface 34A of the outer roller 34, and the outer roller 34 is supported rotatably about a central axle of the guide roller 128.

Figures 12A, 12B, 12C:
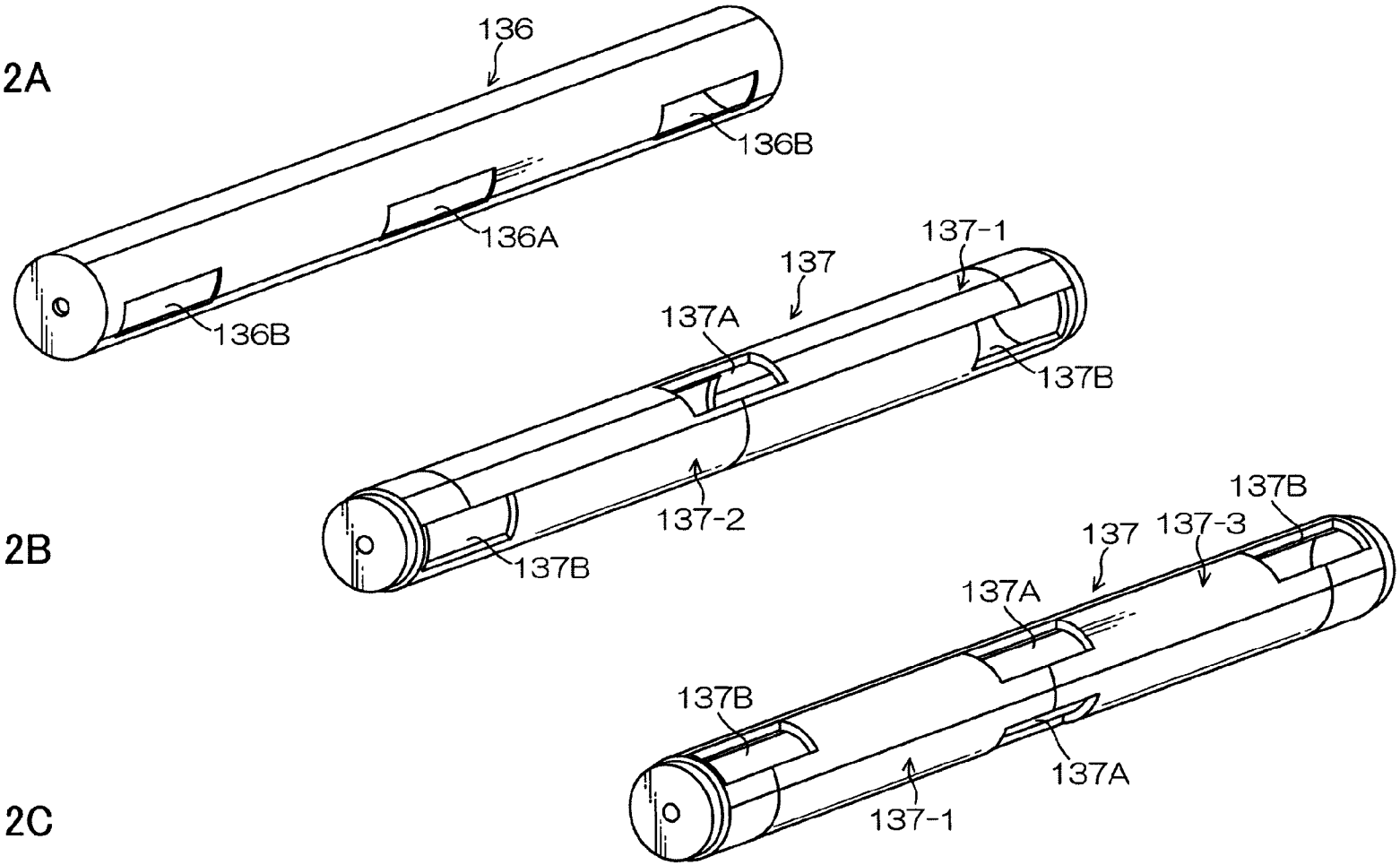
FIGS. 12A to 12C are diagrams each showing an internal structure of the guide roller shown in FIG. 10.

FIG. 12A is a perspective diagram of the suction angle cylinder 136. In the suction angle cylinder 136 shown in FIG. 12A, a cutaway section 136A which is cut away in a cylindrical shape is formed in the central portion in the axial direction (lengthwise direction) and a cutaway section 136B which is cut away in a cylindrical shape is formed in the both end portions in the axial direction. The cutaway sections 136A, 136B correspond to the positions of the suction holes 40 in the outer roller 34 and are connected with the suction holes 40.

The suction angle cylinder 136 does not rotate and is supported in a secured position in the rotational direction, in such a manner that that the cutaway sections 136A, 136B are arranged at positions contacting the paper 16. The suction angle of the outer roller 34 is determined by the length of the cutaway sections 136A, 136B in the circumferential direction.

The suction angle cylinder 136 may be configured so as to be rotated in a range of no more than 30°, so that the contact position with the paper can be changed. Moreover, it is also possible to connect the cutaway sections 136A, 136B of the suction angle cylinder 136, and to form a suction port along the axial direction from one end portion of the axial direction of the suction angle cylinder 136 to the other end portion thereof, via the central portion.

FIGS. 12B and 12C are perspective diagrams of a suction position cylinder 137 which is inserted into the suction angle cylinder 136. The suction position cylinder 137 is supported rotatably inside the suction angle cylinder 136, which is secured in position.

The suction position cylinder 137 is divided into three regions in the circumferential direction, and has a first region 137-1 in which only a cutaway section 137A is formed in the central portion in the axial direction, a second region 137-2 in which only a cutaway section 137B is formed in the both end portions of the axial direction, and a third region 137-3 in which a cutaway section 137A is formed in the central portion in the axial direction and a cutaway section 137B is formed in the both end portions of the axial direction.

FIG. 12B shows the first region 137-1 and the second region 137-2. The third region 137-3 is provided on a rear side, which is not illustrated. Moreover, FIG. 12C shows the third region 137-3 and the first region 137-1. The second region 137-2 is provided on a rear side, which is not illustrated.

Figure 13B:
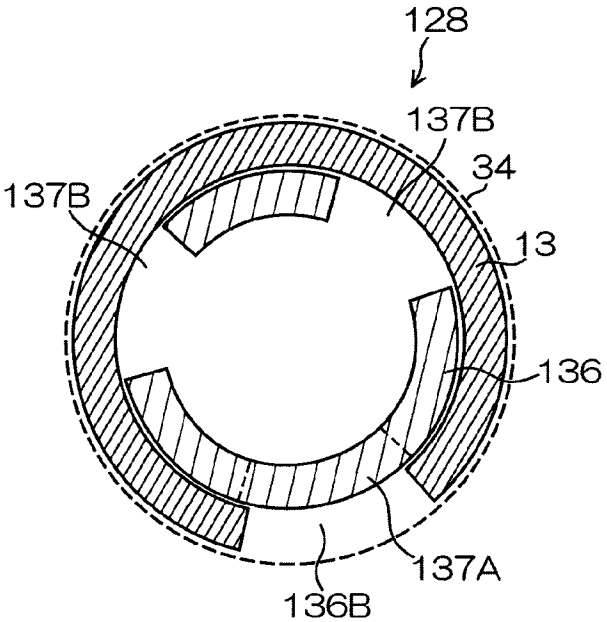
FIGS. 13A and 13B are cross-sectional diagrams each showing an internal structure of the guide roller shown in FIG. 11.
Figure 13A:
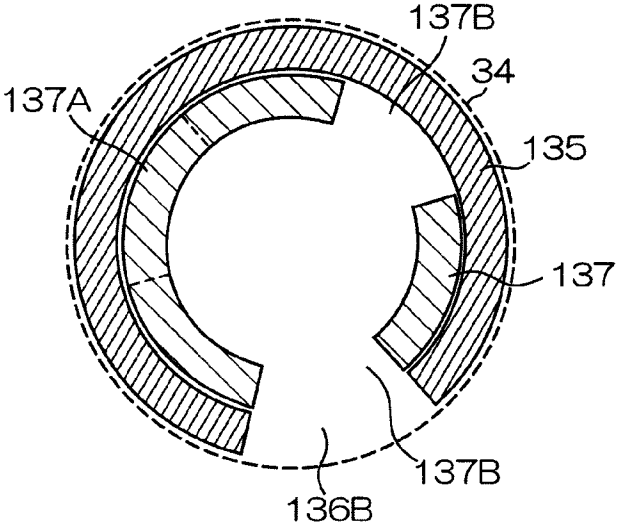

FIGS. 13A and 13B are cross-sectional diagrams of a guide roller 128, along a cross-sectional line which passes through the cutaway section 137B on the far side from the viewer in the FIGS. 12B and 12C. The state shown in FIG. 13A is a state where the cutaway sections 137A, 137B of the third region 137-3 have reached the positions of the cutaway sections 136A,136B of the suction angle cylinder 136.

In this mode, the suction pressure is applied from both the suction holes 40 in either end portion of the guide roller 128 and the suction holes 40 in the central portion. The suction holes 40 of the guide roller 128 are not blocked.

Furthermore, the state shown in FIG. 13B is a state where the cutaway section 137A of the first region 137-1 has reached the position of the cutaway section 136A of the suction angle cylinder 136. In this state, a suction pressure is applied only to the suction holes 40 in the central portion of the guide roller 128 in the axial direction, and the suction holes 40 in either end portion of the guide roller 128 in the axial direction are blocked by the main body of the suction position cylinder 137 and therefore do not generate a suction pressure.

Moreover, although not shown in the drawings, there is a state where the cutaway sections 137B of the suction position cylinder 137 in the second region 137-2 have reached the positions of the cutaway sections 136B of the suction angle cylinder 136. In this state, a suction pressure is applied only to the suction holes 40 in the both end portions of the guide roller 128 in the axial direction, and the suction holes 40 in the central portion of the guide roller 128 in the axial direction are blocked by the main body of the suction position cylinder 137 and therefore do not generate a suction pressure.

In other words, by rotating the suction position cylinder 137 with respect to the suction angle cylinder 136, depending on the position of the suction position cylinder 138, the suction holes 40 are blocked by the main body of the suction position cylinder 137, and furthermore the position where suction pressure is generated (the position in the axial direction) can be changed by connecting the cutaway sections 137A, 137B and the suction holes 40.

By providing a cutaway section having a smaller opening surface area than the cutaway section 137B of the second region 137-2, in either end portion of the first region 137-1 in the axial direction, so as to block a portion of the suction holes 40 in either end portion of the guide roller 128, and by providing a cutaway section having a smaller opening surface area than the cutaway section 137A of the first region 137-1, in the central portion of the second region 137-2 in the axial direction, so as to block a portion of the suction holes 40 in the central portion of the guide roller 128, it is possible to create a suction pressure difference between the both end portions and the central portion of the guide roller 128.

Figure 14:
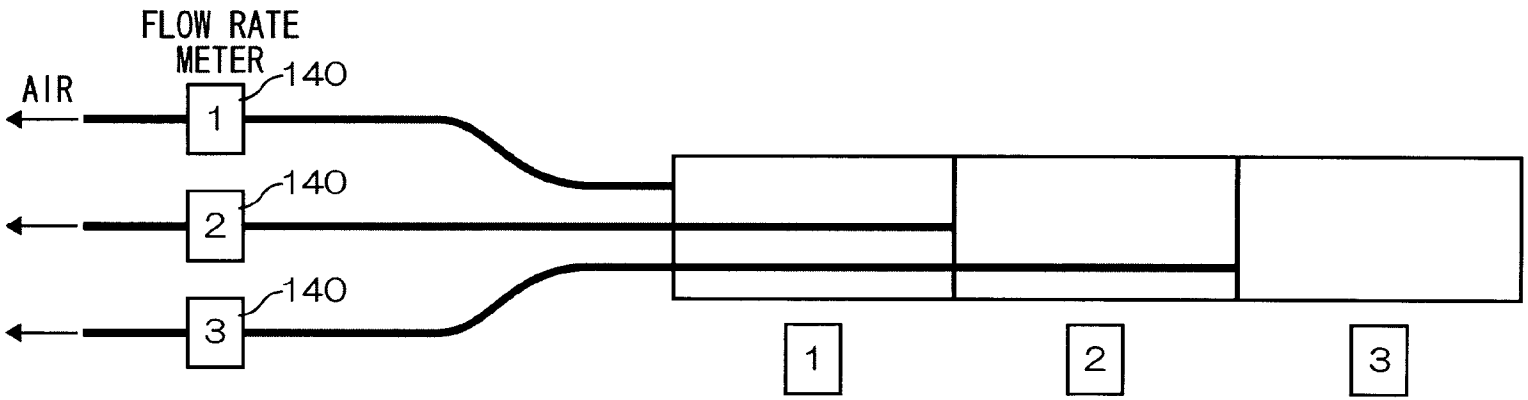
FIG. 14 is an illustrative diagram showing a schematic view of the connection relationship between the guide roller shown in FIG. 11 and flow rate meters.

FIG. 14 is an illustrative diagram showing a schematic view of the connection relationship between a guide roller 128 and flow rate meters 140 (labeled with numerals "1" to "3" in FIG. 14). The flow rate meters 140(1) and 140(3) are connected to either end portion of the guide roller 128 in the axial direction ("1" and "3").

Furthermore, the flow rate meter 140(2) is connected to the central portion ("2") of the guide roller 128 in the axial direction. In this way, the flow rates of the respective sections are ascertained by the three flow rate meters 140(1) to 140(3).

The state of curl of the paper 16 is predicted on the basis of the flow rate information of each section of the guide roller 128, which is obtained by the flow rate meters 140(1) to 140(3), in a state where the paper 16 is suctioned to the guide roller 128.

More specifically, the state of curl of the paper 16 is predicted on the basis of the set suction pressure and the flow rate information obtained from the flow rate meters, with reference to a flat state of the paper 16 (an uncurled state or very slightly curled state). The positions of the first region 137-1, the second region 137-2 and the third region 137-3 of the suction position cylinder 138 are moved automatically in accordance with the predicted state of curl of the paper 16.

In the present embodiment, a mode is described in which the guide roller 128 is divided into three sections in the axial direction and the state of curl of the paper 16 is ascertained on the basis of the flow rate information of each section, but it is also possible to ascertain the state of curl finely by dividing up the guide roller 128 into finer sections.

Figure 15A:
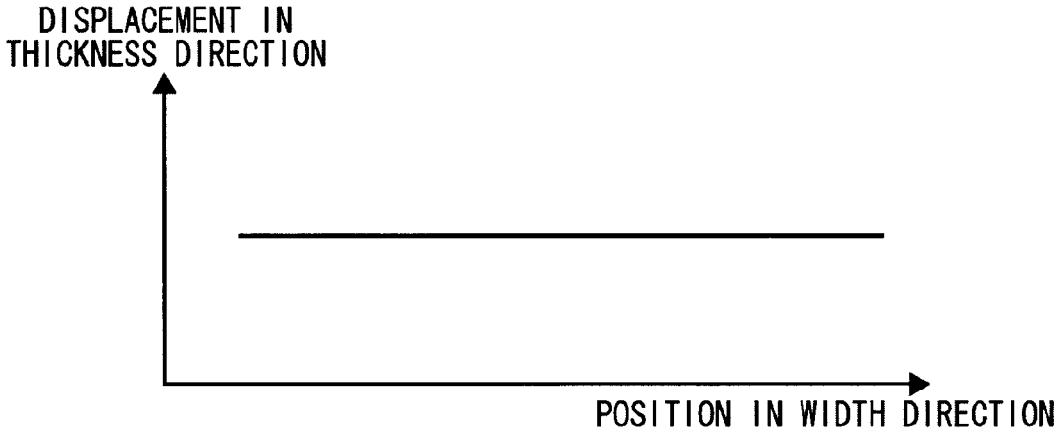
FIGS. 15A to 15C are illustrative diagrams each showing an example of the control of back tension when the paper shape in the paper conveyance apparatus shown in FIG. 10 is flat.
Figure 15B:
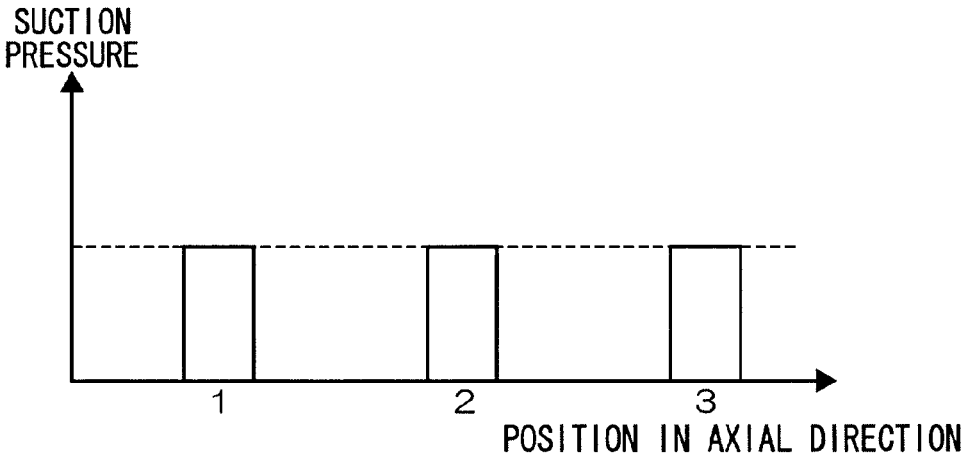
Figure 15C:
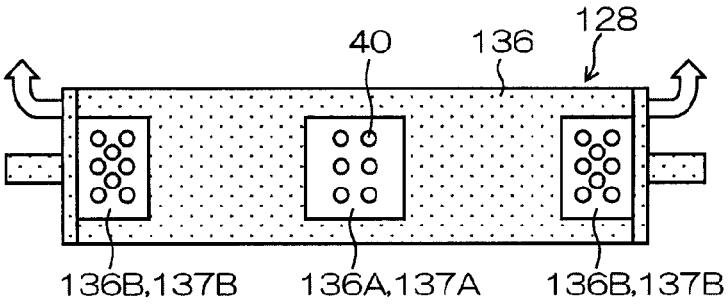
Figure 16A:
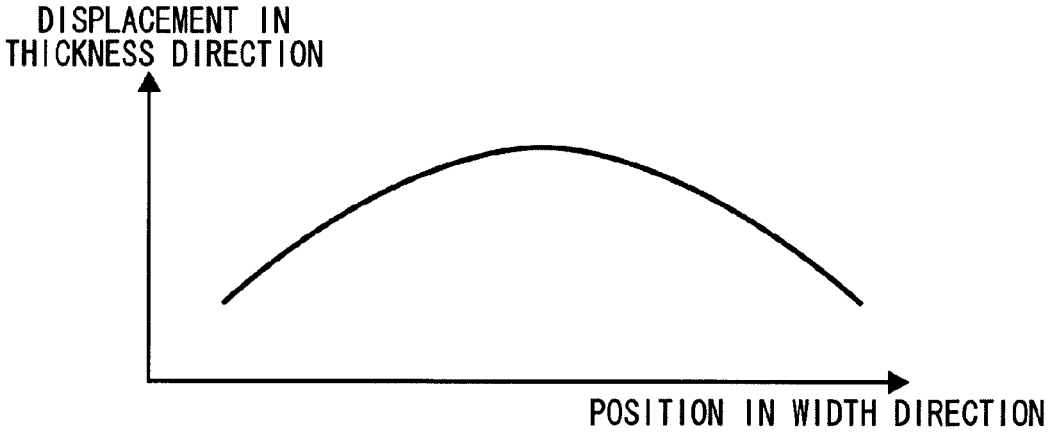
FIGS. 16A to 16C are illustrative diagrams each showing an example of the control of back tension when the paper shape in the paper conveyance apparatus shown in FIG. 10 is a convex shape.
Figure 16B:
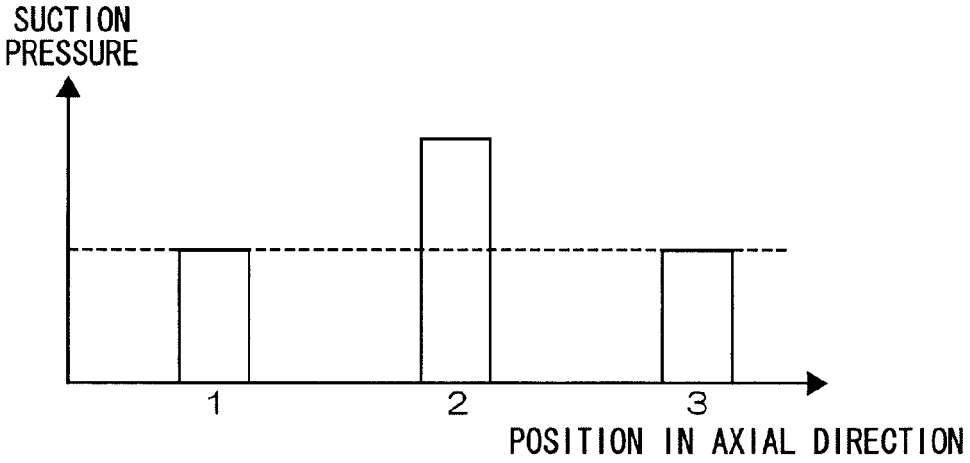
Figure 16C:
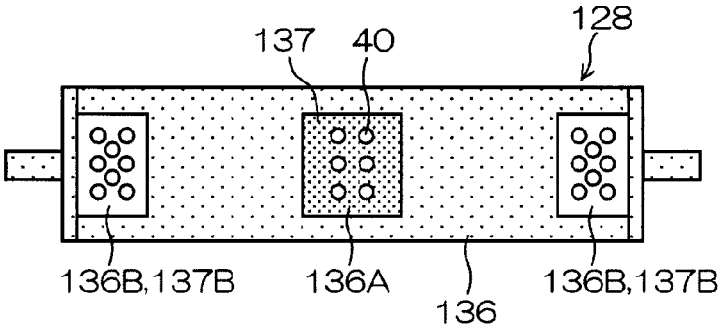
Figure 17A:
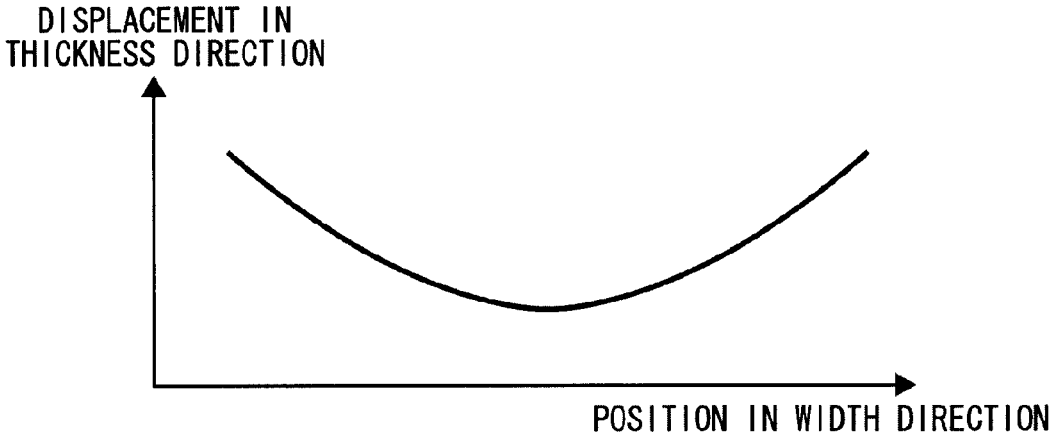
FIGS. 17A to 17C are illustrative diagrams each showing an example of the control of back tension when the paper shape in the paper conveyance apparatus shown in FIG. 10 is a concave shape.
Figure 17B:
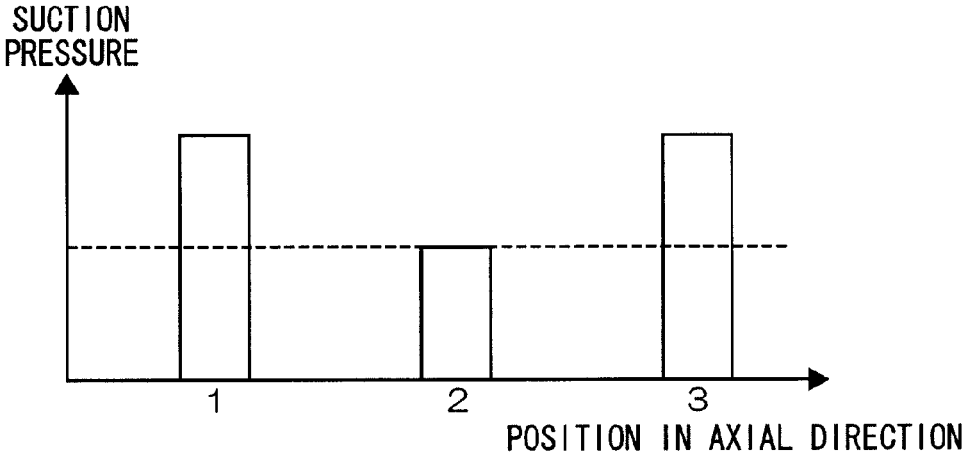
Figure 17C:
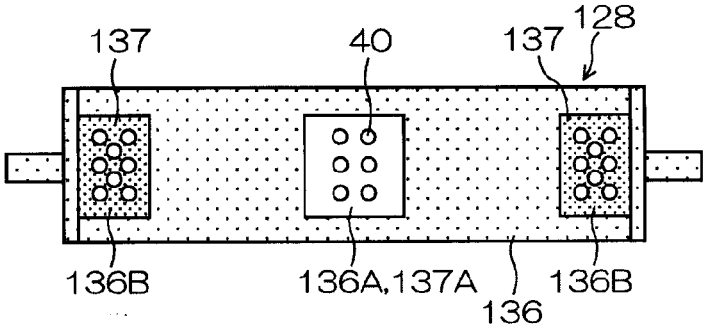

FIGS. 15A to 17C are illustrative diagrams of the control of back tension (control of the suction pressure in the guide roller 128) in accordance with the state of curl of the paper 16; in which FIGS. 15A, 16A, 17A show schematic views of the state of curl of the paper (the position in the width direction of the paper 16 and displacement of the paper 16 in the thickness direction), FIGS. 15B, 16B, 17B show schematic views of the correlation with the suction pressure (the relationship between the position in the axial direction of the guide roller 128 and the suction pressure), and FIGS. 15C, 16C, 17C show schematic views of the state of the suction angle cylinder 136 and the suction position cylinder 138 (the connection relationships between the suction holes 40 and the cutaway sections 136A, 137A, 136B, 137B).

In the flat state of the paper 16 which is shown in FIG. 15A, when the paper 16 passes through the guide region of the guide roller 128 as shown in FIGS. 15B and 15C, a uniform suction pressure acts on the paper 16 from the suction holes 40 in the central portion and the suction holes 40 in the both end portions in the axial direction of the guide roller 128.

Furthermore, the suction angle cylinder 136 has an expanded suction angle. The white arrow shown in FIG. 15B is a schematic representation of the flow of air (the air flow determined by the air flow meter) when ascertaining the flow rate of the guide roller 128.

On the other hand, when the paper 16 is in a convex curled state as shown in FIG. 16A (a state where the central portion is floating up), then the suction position cylinder 138 is rotated as shown in FIGS. 16B and 16C, thereby blocking the suction holes 40A in the both end portions of the outer roller 34 in the axial direction so as to weaken the suction pressure, as well as making the suction pressure in the central portion relatively stronger.

On the other hand, when the paper 16 is in a concave curled state as shown in FIG. 17A (a state where the edges are floating up), then the suction position cylinder 138 is rotated as shown in FIGS. 17B and 17C, thereby blocking the suction holes 40 in the central portion of the outer roller 34 in the axial direction so as to weaken the suction pressure, as well as making the suction pressure in the both end portions relatively stronger.

For example, in the case of $H_1$, $L_1$, $T<T_1$ in FIG. 9, if the original value of the suction pressure Q is 13 kP, then when the measurement of the flow rate meter is 6 kP to 8 kP, the state of curl of the paper 16 is judged to indicate a convex shape since the space in the central portion is small.

In this case, the angle of the suction angle cylinder 136 and the position of the suction position cylinder 138 are adjusted automatically so as to achieve the state shown in FIG. 16B.

Figure 18:
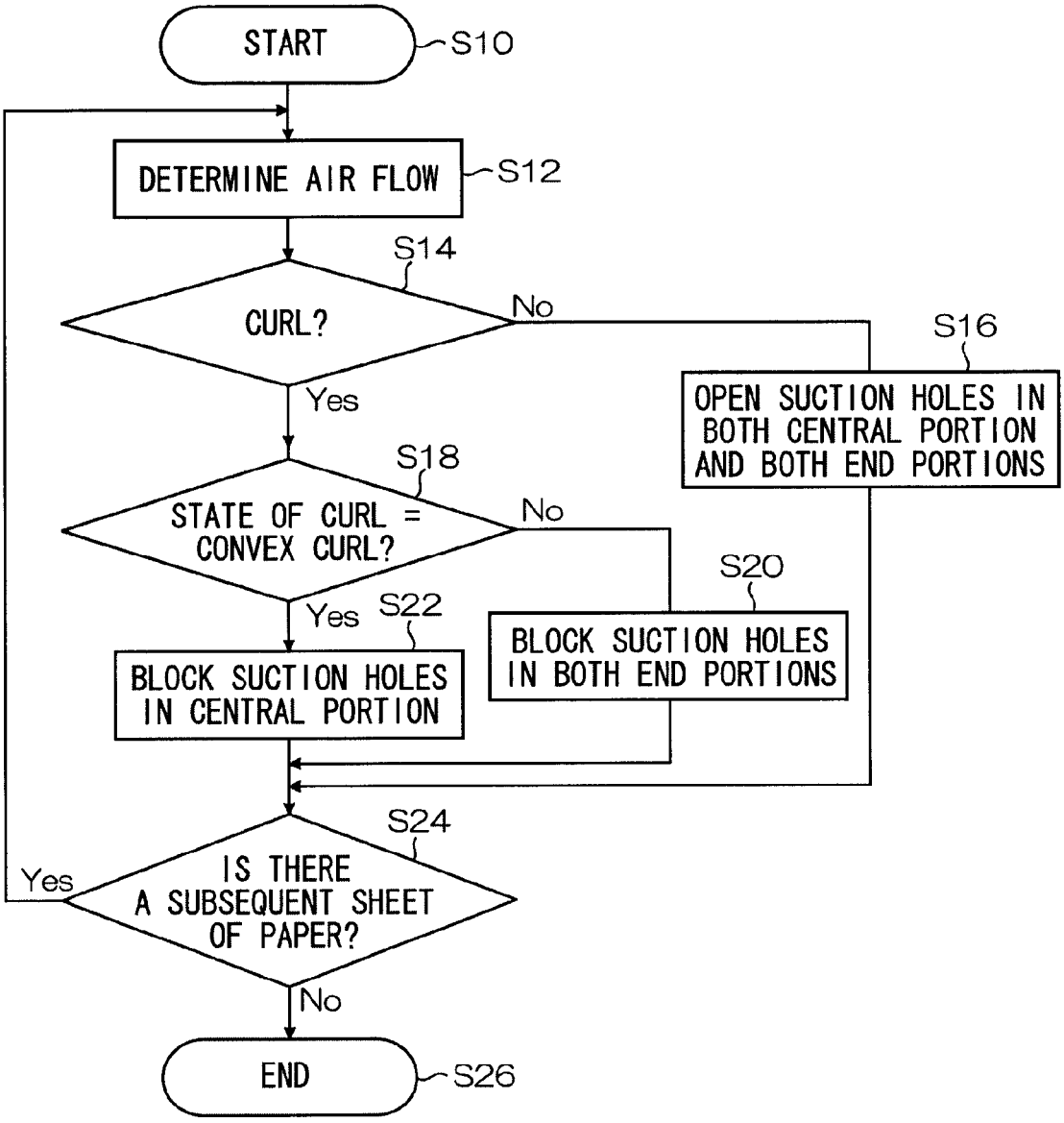
FIG. 18 is a flowchart showing a flow of back tension control in accordance with the paper shape in the paper conveyance apparatus shown in FIG. 10.

FIG. 18 is a flowchart showing a sequence of the back tension control described above. When the application of back tension to the paper 16 is started (step S10), the flow rate in the guide roller 128 is determined (step S12), and the state of curl of the paper 16 is judged (step S14).

In step S14, if it is judged that the paper 16 is not curled (NO judgment), then the procedure advances to step S16, and the suction holes 40A, 40B in the central portion and the both end portions of the guide roller 128 are opened (see FIG. 15B).

On the other hand, if it is judged at step S14 that the paper 16 is curled (YES judgment), then the procedure advances to step S18, and it is judged whether the state of curl of the paper 16 is convex or concave. At step S18, if it is judged that the paper 16 has concave curl (NO judgment), then the suction holes 40B in the central portion of the guide roller 128 are blocked (step S20, see FIG. 17B) and the procedure advances to step S22.

On the other hand, if it is judged at step S18 that the paper 16 has convex curl (YES judgment), then the suction holes 40A in the both end portions of the guide roller 128 are blocked (step S24, see FIG. 16B) and the procedure advances to step S24.

When the paper 16 has passed the guide region of the guide roller 128 while a back tension is applied to the paper 16, it is judged whether or not there is a subsequent sheet of paper 16 (step S24). If there is a subsequent sheet of paper (YES judgment), then the procedure returns to step S12, and the steps from S12 onwards are repeated.

On the other hand, if it is judged at step S24 that there is no subsequent sheet of paper 16 (NO judgment), then the control of back tension is terminated (step S26).

According to the paper conveyance apparatus 120 relating to the third embodiment described above, it is possible to vary the position at which a suction pressure is generated in the guide roller 128, and therefore a back tension which corresponds to the deformation (curl) of the paper 16 can be applied.

Furthermore, since the state of curl of the paper 16 is ascertained from the flow rate of the guide roller 128 and the position at which suction pressure is generated in the guide roller 128 is changed in accordance with the state of curl of the paper 16, then it is possible to adjust the back tension in accordance with the state of curl of the paper 16.

In the guide roller 28 having a dual structure which is shown in FIG. 2 to FIG. 4, by providing a structure which blocks off the suction holes 40 in the outer roller 34 and the inner roller 36, it is possible to selectively switch the position at which a back tension is applied, in accordance with the state of curl of the paper 16.

Modification Example

Figure 19:
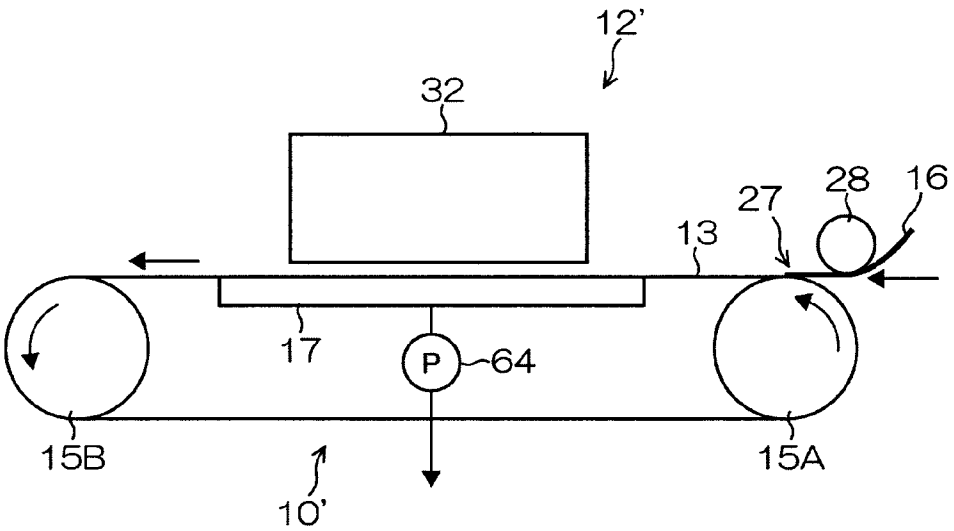
FIG. 19 is a schematic drawing of an inkjet recording apparatus comprising a paper conveyance apparatus relating to a fourth embodiment of the present invention.

Next, a modification example of the paper conveyance apparatus 10 (100, 200) explained above will be described. FIG. 19 is a general schematic drawing showing an approximate composition of a paper conveyance apparatus 10' (inkjet recording apparatus 12') relating to a modification example.

The paper conveyance apparatus 10' shown in FIG. 19 employs a belt conveyance method, instead of the pressure drum conveyance method in FIG. 1. The paper conveyance apparatus 10' which conveys the paper 16 has a structure in which an endless belt 13 is wound about rollers 15A, 15B, and by rotating a drive roller 15A (15B), the paper 16 which is supported on the front surface of the belt 13 is conveyed from right to left in FIG. 19.

A plurality of suction holes (not illustrated) are provided in the surface of the belt 13 and the suction holes are connected to a chamber 17. By operating the paper suction pump 64 connected to the chamber 17 to generate a negative pressure inside the chamber 17, the paper 16 is suctioned onto the surface of the belt 13 via the suction holes.

The guide roller 28 shown in FIG. 19 is arranged immediately before the position (support start position) 27, in a conveyance path of the paper 16, where the paper 16 starts to be supported securely on the belt 13, on the upstream side of this position 27 in terms of the paper conveyance direction, and applies a back tension to the paper 16 of which at least a portion is securely supported on the belt 13.

By applying a back tension to the paper 16 from the guide roller 28, floating and creasing of the paper 16 which is suctioned and held on the belt 13 is prevented while passing through the guide region of the guide roller 28.

A desirable mode is one where a separate guide member is provided at a support start position 13A of the paper 16 on the belt 13. According to this mode, the leading end portion of the paper 16 may be prevented from floating up immediately before being supported on the belt 13.

The inkjet head 32 ejects colors inks onto the paper 16 which is supported on the belt 13. The composition of the inkjet head 32 may correspond to the four colors of K, C, M and Y as shown in FIG. 1, or may additionally include light inks (light cyan, light magenta, and the like).

Further Examples of Apparatus Composition

Figure 20:
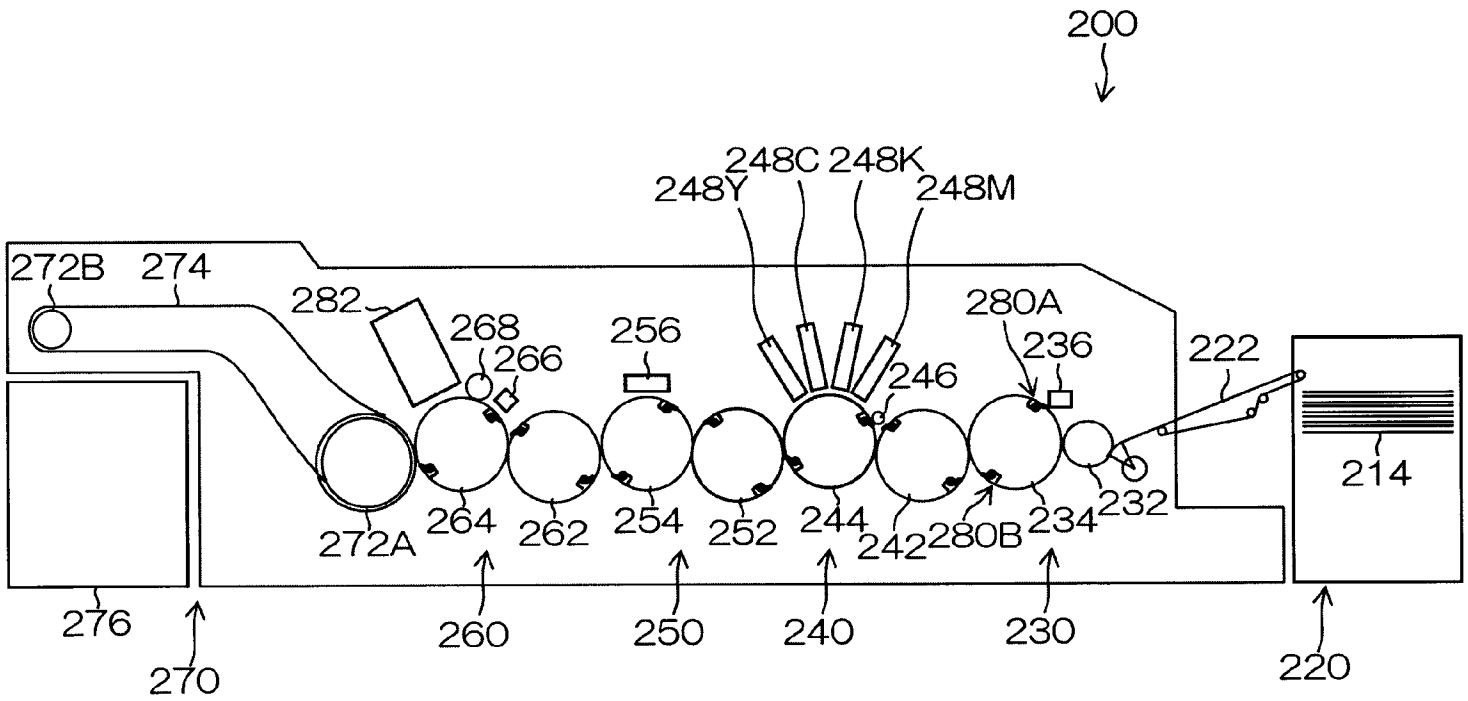
FIG. 20 is a general schematic drawing showing a further example of the composition of an inkjet recording apparatus comprising a paper conveyance apparatus relating to the present invention.

Next, further apparatus compositions will be described. FIG. 20 is a general schematic drawing of an inkjet recording apparatus 200 based on a two-liquid aggregation method. The inkjet recording apparatus 200 shown in FIG. 20 employs a pressure drum conveyance method as a conveyance method for a recording medium (paper) 214.

As shown in FIG. 20, the recording medium 214 which has been paid out from a paper feed unit 220 is transferred from a paper feed tray 222 to a transfer drum 232. The recording medium 214 of which the leading end portion is gripped by grippers provided on the transfer drum 232 (in the drawing, grippers are indicated by reference numerals 280A, 280B in relation to the application drum 234 which is described below) is transferred to an application drum 234 of a treatment liquid application unit 230.

A treatment liquid application apparatus 236 applies an aggregating treatment liquid to the recording medium 214 of which the leading end portion has been gripped by the grippers 280A (280B) of the application drum 234. The aggregating treatment liquid reacts with ink and aggregates or insolubilizes coloring material which is contained in the ink.

The method of applying the aggregating treatment liquid may employ a roller application method, an inkjet method, or the like. The recording medium 214 on which the aggregating treatment liquid has been applied is transferred to a transfer drum 242 and then transferred further to an image formation drum 244 of the printing unit 240.

The image formation drum 244 in FIG. 20 corresponds to the pressure drum 14 in FIG. 1 and the guide roller 246 corresponds to the guide roller 28 in FIG. 1. Furthermore, the inkjet heads 248M, 248K, 248C and 248Y correspond to the inkjet head 32 in FIG. 1.

The recording medium 214 on which a color image has been formed by the printing unit 240 is received on a drying drum 254 of a drying processing unit 250 via a transfer drum 252. In the drying processing unit 250, a drying processing apparatus 256 carries out a drying process on the recording medium 214 on which a color image has been formed. The drying process may employ a heating process, an air blowing process, or a combination of these.

The recording medium 214 on which a drying process has been carried out is transferred onto a fixing drum 264 of a fixing processing unit 260 via a transfer drum 262. In the fixing processing unit 260, a heating process is carried out by a heater 266 and a pressurization process is carried out by a fixing roller 268.

Thereupon, a test pattern formed on the recording medium 214 is read in by an in-line sensor 282. The read information of the test pattern which is acquired by the in-line sensor 282 is used to judge whether or not there is an ejection abnormality in the inkjet heads 248M, 248K, 248C and 248Y.

The recording medium 214 which is paid out from the fixing processing unit 260 is conveyed by a conveyance chain 274 wrapped about rollers 272A, 272B provided in an output unit 270, and is accommodated in the output tray 276.

In the present specification, an inkjet recording apparatus which forms a color image using color inks is given as an example of the application of a paper conveyance apparatus 10 (10', 100, 120) relating to the present embodiment, but the paper conveyance apparatus may be applied widely to apparatuses which carry out prescribed processing on paper in a state where the flatness of the paper (recording medium) is guaranteed (such as an application apparatus, a coating apparatus, or an image forming apparatus based on an electrophotographic method).

Furthermore, the paper conveyance apparatus may also be applied to a pattern forming apparatus in the field of industrial apparatuses (a wiring pattern forming apparatus for printed substrates, a mask pattern forming apparatus for base materials, and the like).

APPENDIX

As has become evident from the detailed description of the embodiment of the present invention given above, the present specification includes disclosure of various technical ideas including at least the inventions described below.

Invention 1: A medium conveyance apparatus, comprising: a medium conveyance unit which has a medium supporting region that supports a rear surface of a medium and which conveys the medium in a prescribed conveyance direction while supporting the medium; and a guide section which is disposed adjacently on an upstream side, in terms of the medium conveyance direction, to a support start position where secure supporting of the medium by the medium conveyance unit is started in a conveyance path of the medium, and which contacts a front surface of the medium and causes the medium to make tight contact with the medium conveyance unit, wherein the guide section has a suction port provided in a position opposing the medium and applies a back tension to the medium, at least a portion of which is securely supported by the medium supporting region, by applying suction pressure from the suction port to a portion of the medium that is not securely supported by the medium supporting region.

According to the present invention, in a medium conveyance apparatus which securely supports and conveys a medium, by providing a function for applying a back tension to the medium, in a guide section which forms a guide for supporting the medium in a medium conveyance unit, it is possible to apply a back tension to the medium of which at least a portion is securely supported by the medium conveyance unit, thereby restricting the occurrence of creasing and floating when the medium is securely supported by the medium conveyance unit and maintaining the flatness of the medium which is securely supported by the medium conveyance unit.

Possible examples of a mode of the medium conveyance unit are a pressure drum conveyance method and a belt conveyance method. Furthermore, a mode is also possible in which a plurality of suction holes for generating a suction pressure are provided in the medium supporting region.

"Back tension" means backwardly pulling the medium which is conveyed in the prescribed conveyance direction, and may employ suction pressure, frictional force, or the like.

A desirable mode is one where the suction port which is provided in the guide section has a length corresponding to the entire length of the medium in the direction perpendicular to the conveyance direction of the medium.

The planar shape of the suction port provided in the guide section may employ a rectangular or oval shape, or the like. Moreover, it is also possible to adopt a mode in which a plurality of suction ports each having a circular planar shape are arranged through a length corresponding to the entire length of the medium in a direction perpendicular to the conveyance direction.

Invention 2: The medium conveyance apparatus as defined in invention 1, further comprising a suction pressure application unit which generates suction pressure for suctioning a rear side of the medium, in the medium supporting region of the medium conveyance unit, wherein a relationship between an absolute value |W| of a suction pressure W applied to the medium by the suction pressure application unit and an absolute value |Q| of a suction pressure Q applied to the medium by the guide section satisfies the following relationship: $|W|\times 2<|Q|$.

According to this mode, since the absolute value of the suction pressure Q forming a back tension exceeds two times the absolute value of the suction pressure W for supporting the medium on the medium supporting region, then it is possible to apply a back tension reliably to the medium.

Invention 3: The medium conveyance apparatus as defined in invention 1 or 2, wherein the guide section includes: a rotating roller having a hollow cylindrical shape and supported rotatably about a central axle; and a secure roller which is inserted inside the rotating roller and is securely supported, a plurality of suction holes are provided in a surface of the rotating roller which contacts the medium, and the suction port is provided in the secure roller along a direction parallel to the central axle.

According to this mode, by adopting a dual structure for the guide section, in which a secure roller is inserted into a rotating roller, then as well as generating a suction pressure from the secure roller, a load is generated due to frictional (rubbing) resistance from the rotating roller, and a back tension can be applied effectively to the medium due to this pressure and load acting on the medium.

Invention 4: The medium conveyance apparatus as defined in invention 3, further comprising a curl state judging device which judges a state of curl of the medium, wherein the guide section has a blocking section which blocks at least a portion of the suction holes provided in a central portion in the axial direction and at least a portion of the suction holes provided in both end portions in the axial direction, and if the judged state of curl of the medium indicates a convex shape on the front surface side, then at least a portion of the suction holes provided in the central portion in the axial direction are blocked by the blocking section, and if the judged state of curl of the medium indicates a concave shape on the front surface side, then at least a portion of the suction holes provided in the both end portions in the axial direction are blocked by the blocking section.

According to this mode, curl in the medium can be corrected by altering the position at which suction pressure is generated, in accordance with the state of curl of the medium.

Invention 5: The medium conveyance apparatus as defined in invention 4, wherein the curl state judgment device judges the state of curl of the medium according to a suction flow rate in the guide section.

In this mode, desirably, a flow rate determination (measurement) device for determining (measuring) a suction flow rate in the guide section is provided.

Invention 6: The medium conveyance apparatus as defined in invention 1 or 2, wherein the guide section includes: a rotating roller having a hollow cylindrical shape and supported rotatably about a central axle; a suction angle adjusting roller having a hollow cylindrical shape, inserted inside the rotating roller and supported securely on the central axle of the rotating roller; and a suction position adjusting roller inserted inside the suction angle adjusting roller, configured rotatably with respect to the suction angle adjusting roller and supported on the central axle of the rotating roller, a plurality of suction holes are provided in a surface of the rotating roller which contacts the medium, a suction port which applies suction pressure to the medium is provided in the suction angle adjusting roller, along a direction parallel to the central axle, and the suction position adjusting roller includes a blocking section which blocks at least a portion of the suction port in both end portions or a central portion of the suction angle adjusting roller in the axial direction.

According to this mode, by adopting a triple structure consisting of a rotating roller, a suction angle adjusting roller and a suction position adjusting roller, for the guide section, it is possible to change the position at which suction pressure is applied from the guide section, and the magnitude of the suction pressure, in accordance with the curled state of the medium, and hence the curl in the medium can be corrected.

The angle adjusting roller may adopt a mode in which cutaway sections are provided in the central portion and the both end portions of the axial direction or a mode where the suction port reaches from one end portion in the axial direction, via the central portion, to the other end portion.

In a mode where cutaway sections are provided in the central portion and the both end portions of the axial direction of the angle adjusting roller, it is possible to adopt a mode where three regions are provided in the circumferential direction of the suction position adjusting roller, namely, a first region in which a cutaway section corresponding to a cutaway section of a central portion of the angle adjusting roller in the axial direction is provided in the central portion of the axial direction only, a second region in which cutaway sections corresponding to both end portions of the angle adjusting roller in the axial direction are provided in the both end portions of the axial direction only, and a third region in which cutaway sections corresponding to cutaway sections of the central portion and the both end portions of the angle adjusting roller in the axial direction are provided in the central portion and the both end portions of the axial direction.

Invention 7: The medium conveyance apparatus as defined in invention 6, further comprising a curl state judging device which judges a state of curl of the medium, wherein if the judged state of curl of the medium indicates a convex shape on the front surface side, then at least a portion of the suction holes provided in the central portion in the axial direction are blocked by the blocking section, and if the judged state of curl of the medium indicates a concave shape on the front surface side, then at least a portion of the suction holes provided in the both end portions in the axial direction are blocked by the blocking section.

According to this mode, curl in the medium can be corrected by altering the position at which suction pressure is generated, in accordance with the state of curl of the medium.

Invention 8: The medium conveyance apparatus as defined in invention 7, wherein the curl state judgment device judges the state of curl of the medium according to a suction flow rate in the guide section.

In this mode, desirably, a flow rate determination (measurement) device for determining (measuring) a suction flow rate in the guide section is provided.

Invention 9: The medium conveyance apparatus as defined in any one of inventions 1 to 8, further comprising a blowing unit which blows air toward the medium from a rear surface side of the medium.

According to this mode, even when using a medium to which it is difficult to apply a back tension, it is possible to apply a back tension to the medium in a reliable fashion.

Invention 10: The medium conveyance apparatus as defined in invention 9, further comprising: a blowing control unit which controls the blowing unit in such a manner that a relationship between an absolute value |W| of a suction pressure W applied to the medium by a suction pressure application unit, an absolute value |Q| of a suction pressure Q applied to the medium by the guide section, and an absolute value |E| of an air blowing pressure E applied to the medium by the air blowing unit satisfies the following relationship: $|W|\times 2<|Q|+|E|$.

According to this mode, it is possible to apply a back tension to the medium which takes account of air blowing by the blowing unit, and the occurrence of floating or creasing due to flapping of the medium can be avoided.

Invention 11: The medium conveyance apparatus as defined in invention 10, wherein the blowing control unit controls the blowing unit such that air is blown from the blowing unit towards a trailing end portion of the medium, when the trailing end portion of the medium passes an air blowing region of the blowing unit.

According to this mode, by blowing air onto the trailing end portion of the medium, it is possible to minimize flapping which is liable to occur in the trailing end portion of the medium.

Invention 12: The medium conveyance apparatus as defined in invention 10 or 11, wherein the blowing control unit halts air blowing by the blowing unit if a sum of the absolute value |E| of the blowing pressure E and the absolute value |Q| of the suction pressure Q exceeds five times the absolute value |W| of the suction pressure W applied to the medium by the suction pressure application unit.

According to this mode, application of an excessive back tension to the medium is avoided.

Invention 13: The medium conveyance apparatus as defined in any one of inventions 1 to 12, wherein a shortest distance between the guide section and the medium conveyance unit is no less than 1.5 times and no more than 2 times a maximum value of a thickness of the medium that is used.

According to this mode, since the shortest distance between the guide section and the medium conveyance unit is determined in accordance with a relatively thick medium to which it is difficult to apply a back tension, then it is possible to achieve compatibility with media of any thickness.

Invention 14: The medium conveyance apparatus as defined in any one of inventions 1 to 13, wherein the guide section includes a load application unit which applies a constant load to the medium in an opposite direction to the conveyance direction.

Desirably, the load application unit in this mode is configured in such a manner that a constant load is applied to the medium. For example, it is also possible to adopt a mode which increases the surface roughness of the guide section.

Invention 15: The medium conveyance apparatus as defined in invention 14, wherein the load application unit includes a rotation suppressing mechanism which suppresses rotation of the rotatable portion of the guide section.

One example of a rotation suppressing mechanism is a torque limiter.

Invention 16: The medium conveyance apparatus as defined in any one of inventions 1 to 15, wherein the medium conveyance unit includes a pressure drum having a round cylindrical shape, and rotating about a central axle while securely supporting the medium on an outer circumferential surface thereof, thereby conveying the medium in a circumferential direction, the pressure drum has a securing section which secures a leading end portion of the medium at a prescribed position on the outer circumferential surface; and the guide section is arranged on a downstream side, in terms of the medium conveyance direction, of a transfer section where securing of the medium by the securing section is started.

In this mode, desirably, a plurality of suction holes are provided in the outer circumferential surface of the pressure drum, and the medium is supported securely by generating a negative pressure at the suction holes.

Invention 17: An image forming apparatus, comprising: a medium conveyance device which conveys a recording medium in a prescribed conveyance direction while holding the recoding medium; and an image forming device which forms an image on the recording medium conveyed by the medium conveyance device, wherein the medium conveyance device includes: a medium conveyance unit which has a medium supporting region that supports a rear surface of the recording medium and which conveys the recording medium in a prescribed conveyance direction while supporting the recording medium; and a guide section which is disposed adjacently on an upstream side, in terms of the medium conveyance direction, to a support start position where secure supporting of the recording medium by the medium conveyance unit is started in a conveyance path of the recording medium, and which contacts a surface of the medium and causes the recording medium to make tight contact with the medium conveyance unit, and wherein the guide section has a suction port provided in a position opposing the medium and applies a back tension to the recording medium, at least a portion of which is securely supported by the medium supporting region, by applying suction pressure from the suction port to a portion of the recording medium that is not securely supported by the medium supporting region.

In the above inventions, "front surface" of the (recording) medium means a surface to which the guide section (specifically, the guide roller 28, etc.) contacts. In the image forming apparatus, an image is formed on the "front surface". On the other hand, a "rear surface" of the (recording) medium means a reverse side of the "front surface", and the "rear surface" contacts surface of the medium conveyance unit (specifically, the pressure drum 14, etc.) at the medium supporting region.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A medium conveyance apparatus, comprising:

a medium conveyance unit which has a medium supporting region that supports a rear surface of a medium and which conveys the medium in a prescribed conveyance direction while supporting the medium; and a guide section which is disposed adjacently on an upstream side, in terms of the medium conveyance direction, to a support start position where secure supporting of the medium by the medium conveyance unit is started in a conveyance path of the medium, and which contacts a front surface of the medium and causes the medium to make tight contact with the medium conveyance unit, wherein the guide section has a suction port provided in a position opposing the medium and applies a back tension to the medium, at least a portion of which is securely supported by the medium supporting region, by applying suction pressure from the suction port to a portion of the medium that is not securely supported by the medium supporting region, and wherein the guide section includes:

a rotating roller having a hollow cylindrical shape and supported rotatably about a central axle; and a secure roller which is inserted inside the rotating roller and is securely supported, a plurality of suction holes are provided in a surface of the rotating roller which contacts the medium, and the suction port is provided in the secure roller along a direction parallel to the central axle, and wherein the medium conveyance apparatus further comprises a curl state judging device which judges a state of curl of the medium, wherein the guide section has a blocking section which blocks at least a portion of the suction holes provided in a central portion in the axial direction and at least a portion of the suction holes provided in both end portions in the axial direction, and if the judged state of curl of the medium indicates a convex shape on the front surface side, then at least a portion of the suction holes provided in the central portion in the axial direction are blocked by the blocking section, and if the judged state of curl of the medium indicates a concave shape on the front surface side, then at least a portion of the suction holes provided in the both end portions in the axial direction are blocked by the blocking section.

2. The medium conveyance apparatus as defined in claim 1, further comprising a suction pressure application unit which generates suction pressure for suctioning a rear side of the medium, in the medium supporting region of the medium conveyance unit, wherein a relationship between an absolute value |W| of a suction pressure W applied to the medium by the suction pressure application unit and an absolute value |Q| of a suction pressure Q applied to the medium by the guide section satisfies the following relationship:

$$|W|\times 2<|Q|.$$

3. The medium conveyance apparatus as defined in claim 1, wherein the curl state judgment device judges the state of curl of the medium according to a suction flow rate in the guide section.

4. The medium conveyance apparatus as defined in claim 1, wherein the guide section includes:

a rotating roller having a hollow cylindrical shape and supported rotatably about a central axle;

a suction angle adjusting roller having a hollow cylindrical shape, inserted inside the rotating roller and supported securely on the central axle of the rotating roller; and a suction position adjusting roller inserted inside the suction angle adjusting roller, configured rotatably with respect to the suction angle adjusting roller and supported on the central axle of the rotating roller, a plurality of suction holes are provided in a surface of the rotating roller which contacts the medium, a suction port which applies suction pressure to the medium is provided in the suction angle adjusting roller, along a direction parallel to the central axle, and the suction position adjusting roller includes a blocking section which blocks at least a portion of the suction port in both end portions or a central portion of the suction angle adjusting roller in the axial direction.

5. The medium conveyance apparatus as defined in claim 4, further comprising a curl state judging device which judges a state of curl of the medium, wherein if the judged state of curl of the medium indicates a convex shape on the front surface side, then at least a portion of the suction holes provided in the central portion in the axial direction are blocked by the blocking section, and if the judged state of curl of the medium indicates a concave shape on the front surface side, then at least a portion of the suction holes provided in the both end portions in the axial direction are blocked by the blocking section.

6. The medium conveyance apparatus as defined in claim 5, wherein the curl state judgment device judges the state of curl of the medium according to a suction flow rate in the guide section.

* * * * *